US007646359B2

(12) United States Patent
Anai

(10) Patent No.: US 7,646,359 B2
(45) Date of Patent: Jan. 12, 2010

(54) FLAT DISPLAY UNIT AND METHOD FOR CONVERTING COLOR SIGNAL IN THE UNIT

(75) Inventor: Kimio Anai, Fukaya (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 696 days.

(21) Appl. No.: 11/230,883

(22) Filed: Sep. 21, 2005

(65) Prior Publication Data

US 2006/0066513 A1 Mar. 30, 2006

(30) Foreign Application Priority Data

Sep. 30, 2004 (JP) ..... 2004-286876
Aug. 15, 2005 (JP) ..... 2005-235264

(51) Int. Cl.
*G09G 3/20* (2006.01)

(52) U.S. Cl. ..... 345/55; 345/72; 345/88; 345/690

(58) Field of Classification Search ..... 345/87, 345/88, 55, 60, 72, 690
See application file for complete search history.

(56) References Cited

U.S. PATENT DOCUMENTS 5,604,513 A * 2/1997 Takahashi et al. ..... 345/589
6,486,859 B1 * 11/2002 Croll et al. ..... 345/72
6,889,239 B2 * 5/2005 Akahori ..... 708/313
2002/0062328 A1 * 5/2002 Akahori ..... 708/311
2002/0140833 A1 * 10/2002 Hirai ..... 348/280
2003/0067426 A1 * 4/2003 Awamoto et al. ..... 345/72

FOREIGN PATENT DOCUMENTS

JP 5-108032 4/1993

* cited by examiner

*Primary Examiner*—Amare Mengistu
*Assistant Examiner*—Hong Zhou
(74) *Attorney, Agent, or Firm*—Oblon, Spivak, McClelland, Maier & Neustadt, L.L.P.

(57) ABSTRACT

There is disclosed a flat display unit which can obtain color signals adapted to a pixel arrangement. The unit has a gate drive circuit and a source drive circuit. Among R, G, B input video signals, a G signal is regarded as a color signal of a reference, R and B signals are regarded as second and third color signals, a plurality of samples of the R signal are multiplied by coefficients and synthesized to generate a first interpolation color signal R', a plurality of samples of the B signal are multiplied by coefficients and synthesized to generate a second interpolation color signal B'. The R', B' and G signal are successively selected and supplied to the source drive circuit.

3 Claims, 22 Drawing Sheets

FLAT DISPLAY UNIT AND METHOD FOR CONVERTING COLOR SIGNAL IN THE UNIT

CROSS-REFERENCE TO RELATED APPLICATIONS

This application is based upon and claims the benefit of priority from prior Japanese Patent Applications No. 2004-286876, filed Sep. 30, 2004; and No. 2005-235264, filed Aug. 15, 2005, the entire contents of both of which are incorporated herein by reference.

BACKGROUND OF THE INVENTION

1. Field of the Invention

The present invention relates to a flat display unit such as a liquid crystal display unit, a plasma display unit, an electron emission display unit, or a display unit using an organic EL, and an interpolation signal generation method, more particularly to improvement of a technology which supplies color signals to color pixels.

2. Description of the Related Art

For example, video signals (color signals of R, G, B) of one system are supplied to a flat display unit into which color digital signals are input based on a clock signal (CLK). The color signals of R, G, B have the same image phase. That is, when one of color pixels is seen, an image of one point is color-decomposed, and prepared as the color signals of R, G, B.

On the other hand, when a pixel arrangement of the flat display unit is seen, three primary colors cannot be represented by one point. Therefore, R, G, B pixels are arranged in order in a scanning line (row) direction, and the arrangement of the pixels of three colors is repeated (see, e.g., Jpn. Pat. Appln. KOKAI Publication No. 5-108032).

When a relation between the three color signals and the pixel arrangement is seen from a spatial frequency, the phase of each color signal is displayed as a 120-degree shifted image. In the flat display unit, data for one horizontal scanning period is written together into the respective pixels of one row. That is, a pixel electrode portion of each pixel is charged with pixel image data corresponding to each pixel. Therefore, the above-described deviation of 120 degrees also appears as deviation of resolution of the whole image.

In this flat display unit, when the image moving in a horizontal direction is displayed in a screen, picture quality degradation occurs such as bleeding of color. This phenomenon becomes remarkable as a panel size increases.

BRIEF SUMMARY OF THE INVENTION

An object of the embodiments is to provide a flat display unit which can obtain color signals adapted to an arrangement of pixels, and picture quality improvement can be obtained. Another object is to provide a flat display unit capable of appropriately coping with digital input signals even in a case where the digital signals adapted to an arrangement of pixels are input.

To solve the above problem, one embodiment of the present invention is directed to a flat display unit provided with a pixel group which is two-dimensionally arranged in a display region and in which pixels for red (R), green (G) and blue (B) are repeatedly arranged in a row direction; a scanning line group wired in each row of the pixel group; a gate drive circuit which selects each scanning line of the scanning line group every scanning period; a signal line group wired in each column of the pixel group; and a source drive circuit which outputs signals to the signal line group every scanning period and which supplies the signals to the corresponding pixels for red (R), green (G) and blue (B), the flat display unit further comprising a color signal interpolation circuit which defines any one of input video signals of red (R), green (G) and blue (B) as a first color signal of a reference, and the other two input video signals as second and third color signals, and which multiplies a plurality of time-shifted samples of the second color signal by coefficients, respectively, and synthesizes the samples to generate a first interpolation color signal, and which multiplies a plurality of time-shifted samples of the third color signal by coefficients, respectively, and synthesizes the samples to generate a second interpolation color signal; and a signal output circuit which supplies to the source drive circuit the first color signal, the first interpolation color signal, and the second interpolation color signal obtained from the color signal interpolation circuit.

Additional objects and advantages of the embodiments will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described hereinafter with reference to the drawings.

Figure 1:
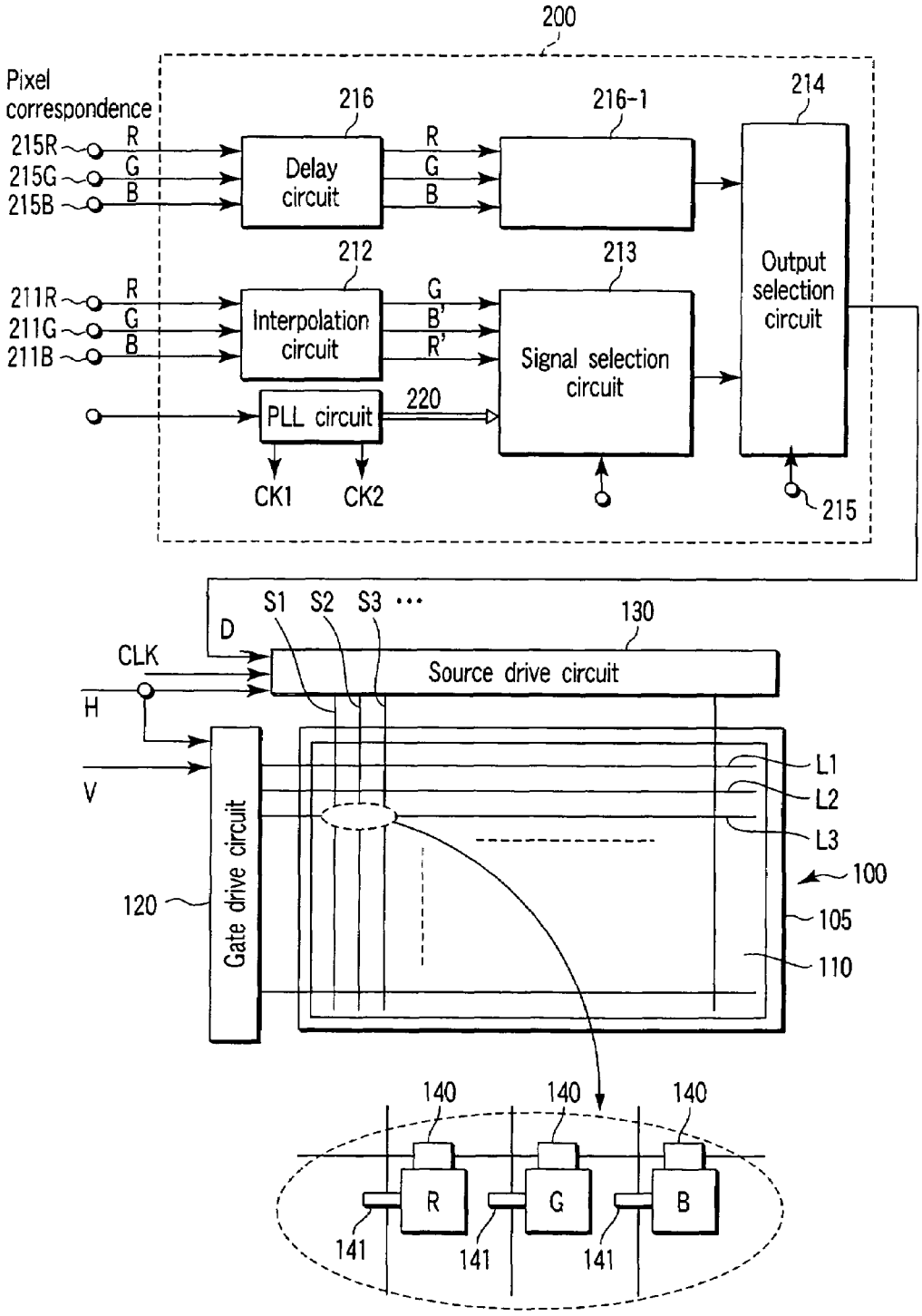
FIG. 1 is an explanatory view showing a constitution of a flat display unit to which the present invention is applied.

In FIG. 1, reference numeral 100 denotes a liquid crystal panel, and a display region 110 is constructed on a glass substrate 105 of this liquid crystal panel 100. In the display region 110, pixels for red (R), green (G) and blue (B) are repeatedly arranged in a row direction. A plurality of rows are arranged to constitute a pixel group. Furthermore, scanning lines L1, L2, L3, . . . are wired in rows of the pixel group to constitute a scanning line group. Furthermore, signal lines S1, S2, S3, . . . are wired in columns of the pixel group to constitute a signal line group.

Moreover, a wiring substrate (not shown) is provided with a gate drive circuit 120 which selects each scanning line of the scanning line group every scanning period, and a source drive circuit 130 which outputs a signal to the signal line group every scanning period.

Furthermore, in the display region 110, there is disposed a pixel switch circuit for supplying the signal from the signal line to the pixel positioned in each intersecting portion of each scanning line of the scanning line group and each signal line of the signal line group in response to a selection signal from the scanning line. As shown in a partially enlarged view, portions denoted with reference numerals 140, 141 constitute the pixel switch circuit.

A horizontal synchronizing signal H and a vertical synchronizing signal V are supplied as timing signals to the gate drive circuit 120. A clock and a horizontal synchronizing signal H for transferring data, and the data are supplied to the source drive circuit 130. The data is a digital color signal output from a data output circuit 200.

The data output circuit 200 will be described. The data output circuit 200 has an interpolation circuit 212 which interpolates the color signals. This interpolation circuit 212 regards one of red (R), green (G), and blue (B) input video signals as a first color signal of a reference, and regards two other input video signals as second and third color signals. The circuit multiplies a plurality of time-shifted samples of the second color signal by coefficients, respectively, and synthesizes them to generate a first interpolation color signal. The circuit also multiplies a plurality of time-shifted samples of the third color signal by coefficients, respectively, and synthesizes them to generate a second interpolation color signal.

The R, G, B input video signals are supplied to input terminals 211R, 211G, 211B. The input video signals are supplied to the interpolation circuit 212. The interpolation circuit 212 outputs the first color signal (e.g., G), the first interpolation color signal (e.g., B'), and the second interpolation color signal (e.g., R'). The first color signal (G), the first interpolation color signal (B'), and the second interpolation color signal (R') are supplied to a signal selection circuit 213, and output in order. The first color signal (G), the first interpolation color signal (B'), and the second interpolation color signal (R') output from the signal selection circuit 213 are input into an output selection circuit 214.

The input video signals R, G, B corresponding to a pixel arrangement may be directly input into the output selection circuit 214 via a delay circuit 216. This system is disposed in order to obtain flexibility in consideration of a case where the input video signals corresponding to a color pixel arrangement of the display region are input. The input video signals R, G, B input via the delay circuit 216 are input into the output selection circuit 214 via a series converter 216-1.

The output selection circuit 214 selects either of a direct signal from the delay circuit 216 and an output signal from the signal selection circuit 213 to supply the signal to the source drive circuit 130. The selection signal supplied to a terminal 215 may be input by a user if necessary, or automatically input. In the automatic input, a circuit is disposed which judges whether or not the input video signal is of a pixel correspondence type.

Reference numeral 220 denotes a phase lock loop circuit which generates clocks CK1, CK2 in synchronization with the synchronizing signal synchronized with the input video signal. Here, various types of timing pulses are generated, and utilized by the respective circuits.

As described later in another embodiment, the signal selection circuit 213 and the series converter 216-1 are not necessarily required. Therefore, in the present specification, a large conceptual circuit including the signal selection circuit 213, the series converter 216-1, and the output selection circuit 214 is defined as a signal output circuit.

Figure 2A:
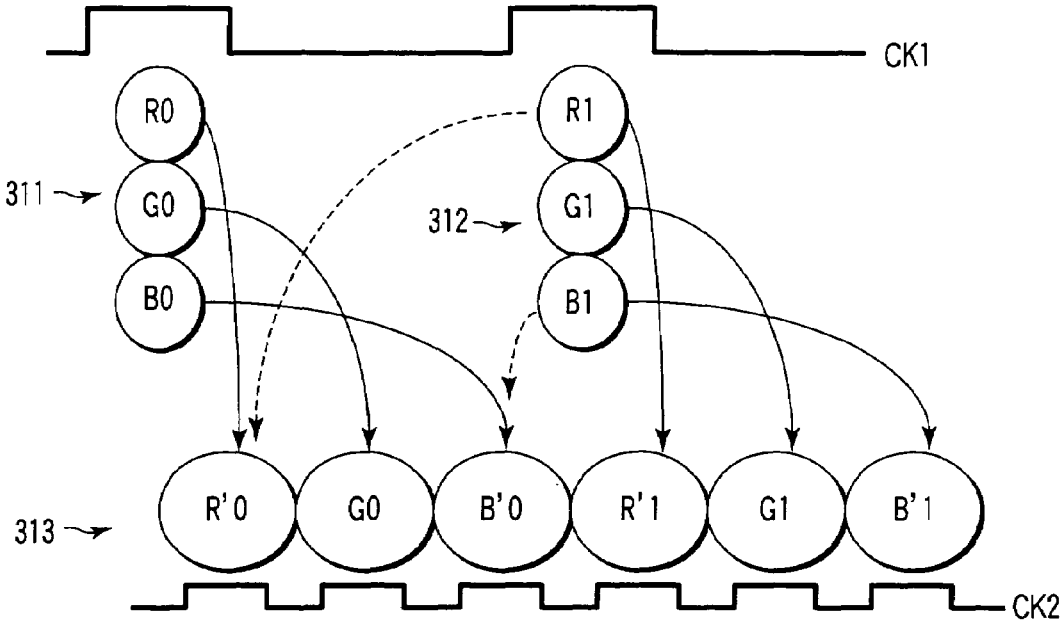
FIGS. 2A, 2B are diagrams showing an operation and a specific constitution example of an interpolation circuit of FIG. 1.

FIG. 2A is an explanatory view showing an operation example of the interpolation circuit 212. Parallel RGB signals are input into the input terminals 211R, 211G, 211B. In FIG. 2A, parallel RGB signals 311, 312 transferred in response to the first clock CK1 are shown as (R0, G0, B0), (R1, G1, B1), Here, it is assumed that the pixels in the display region are arranged in a horizontal direction in series R, G, B, R, G, B, . . . When G is used as a reference, and the parallel RGB signals are arranged in series, as shown in FIG. 2A, series RGB signals 313 are arranged into R'0, G0, B'0, R'1, G1, B'1, . . . Additionally, the respective R, G, B of the parallel RGB signals are not arranged in series without changing any gain. This respect will be described later. This parallel-series conversion is performed in accordance with a physical pixel arrangement.

Here, when the arrangement of the parallel RGB signals 311, 312 is changed to that of the series RGB signals 313, the following respects are seen. That is, since the G signal is the reference, each G sample may maintain its gain as such. However, the R signal is displayed in a position shifted from its original position, and the B signal is also displayed in a position shifted from its original position. As a result, when the R and B signals of the parallel RGB signals are supplied to the corresponding pixels of the series arrangement as such, the signals change to color signals which are different from original color signals represented by the RGB signals. This parallel series conversion is performed by the physical pixel arrangement.

Figure 2B:
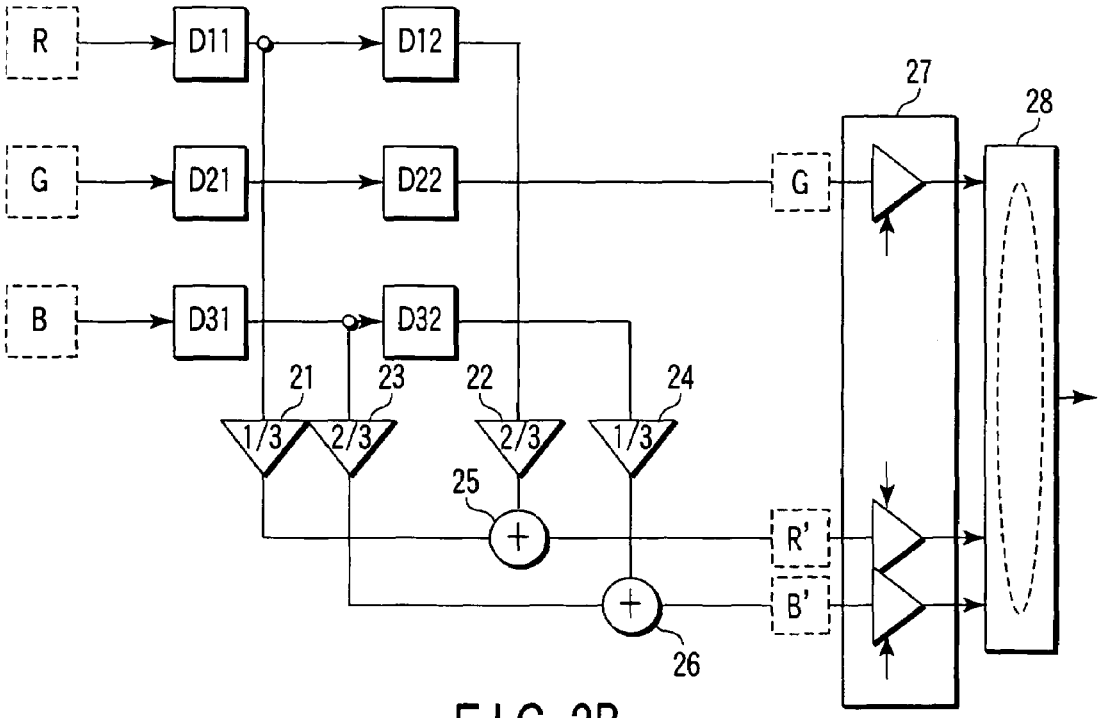

Therefore, the R and B signals need to be corrected in a certain form. FIG. 2B shows a circuit which performs the correction, and this circuit has a basic constitution of the interpolation circuit 212 of FIG. 1. The R signal is input into a series circuit of delay elements D11, D12, the G signal is input into a series circuit of delay elements D21, D22, and the B signal is input into a series circuit of delay elements D31, D32. The R signals on input and output sides of the delay element D12 are input into a ⅓ coefficient unit 21 and a ⅔ coefficient unit 22, gain-controlled, and added up by an adder 25 to constitute an R' signal. The B signals on the input and output sides of the delay element D32 are input into a ⅔ coefficient unit 23 and a ⅓ coefficient unit 24, gain-controlled, and added up by an adder 26 to constitute a B' signal. The G signal is output as such from the series circuit of the delay elements D21, D22.

The G, R', B' signals are adjusted in respect of color balance by a balance adjustment circuit 27 having gain control circuits, and input into a selector 28. This selector 28 is a circuit which selects and derives the respective G, R', B' signals in order to arrange the series RGB signals 313 shown in FIG. 2A.

Figure 3:
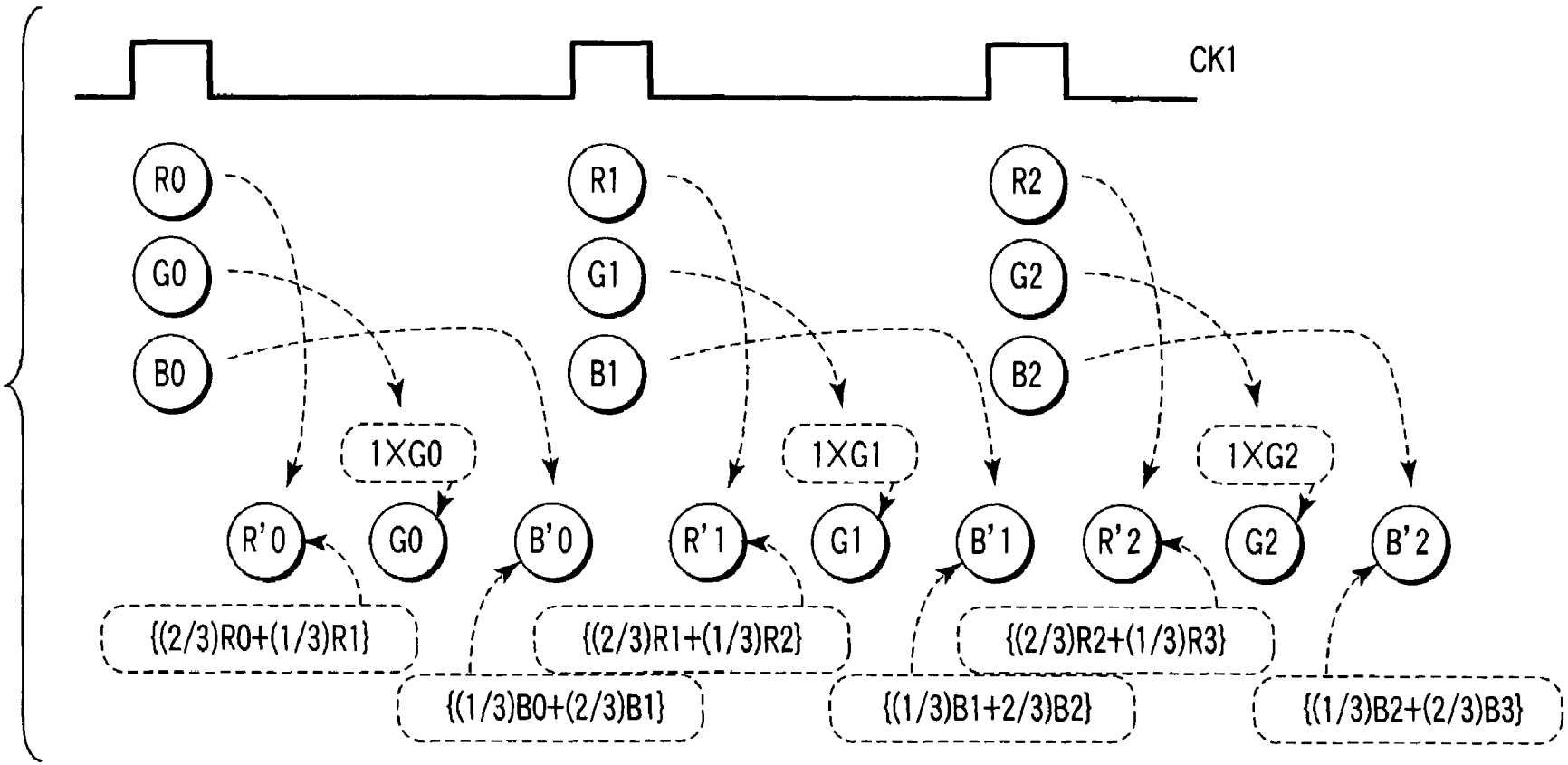
FIG. 3 is an operation explanatory view showing an operation of an operating section of FIG. 2.

FIG. 3 shows an example of a calculation formula in a case where the series RGB signals are obtained by the interpolation circuit 212. As to the G signal, since this signal is the reference, signals (1×G0), (1×G1), . . . are obtained. As to the R signal, signals {(⅔)R0+(⅓)R1}, {(⅔)R1+(⅓)R2}, . . . are obtained. As to the B signal, signals {(⅓)B0+(⅔)B1}, {(⅓)B1+(⅔)B2}, . . . are obtained. In this manner, with respect to the R and B signals, since physical arrangement positions are changed in the series arrangement, influences of components of adjacent pixels are considered.

The above-described processing is interpolating calculation, but the series RGB signals may be obtained by filtering.

Figure 4:
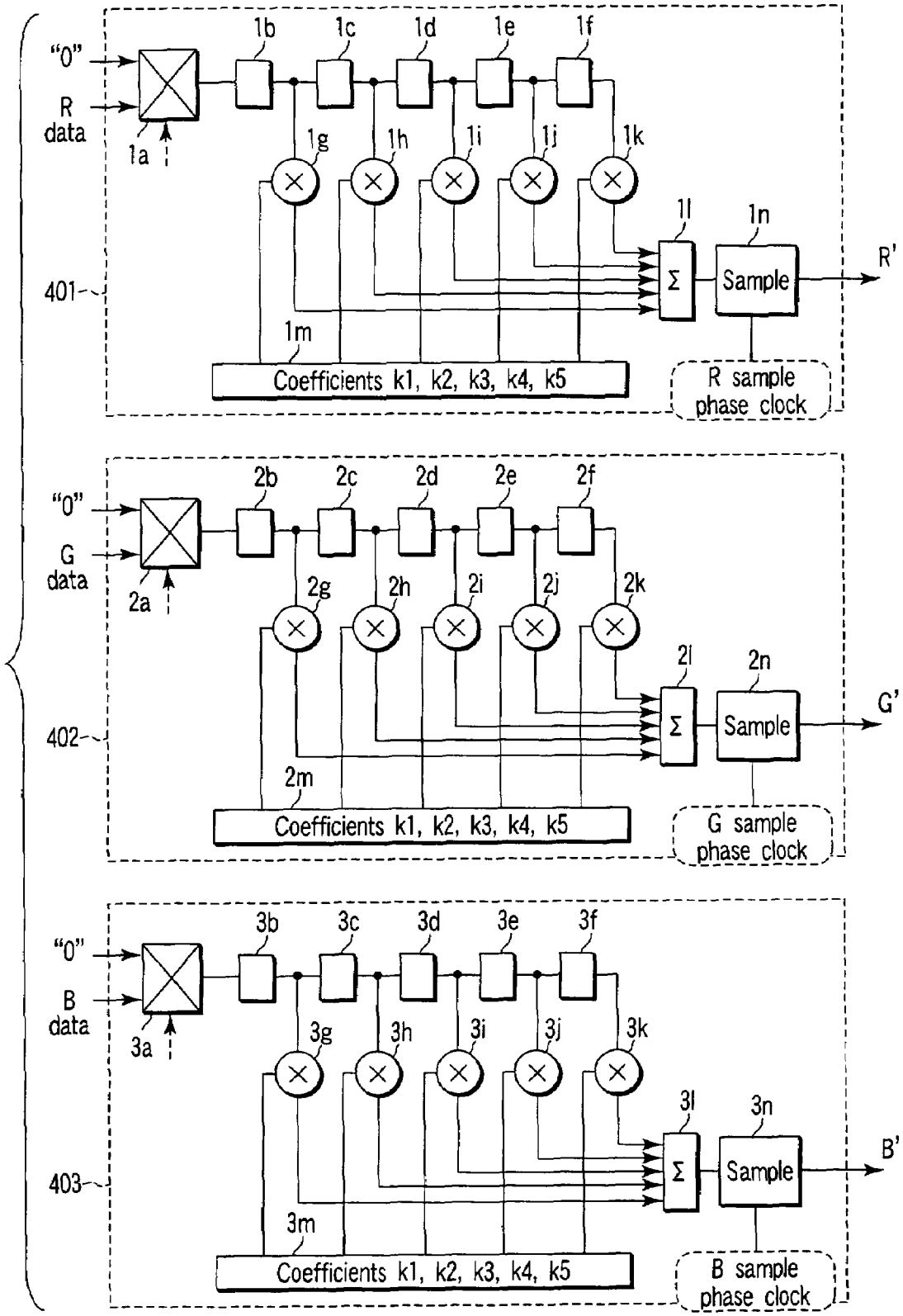
FIG. 4 is a diagram showing a constitution example of another embodiment of the interpolation circuit of FIG. 1.

FIG. 4 shows another example of the interpolation circuit 212. An R signal processing circuit 401, a G signal processing circuit 402, and a B signal processing circuit 403 have the same constitution. The constitution of the R signal processing circuit 401 will be described. The R signal is supplied to a 0 insertion circuit 1*a*. Here, two 0s are inserted between the samples of the R signal. Therefore, a clock frequency is larger than that for the input R signal, and is a three-times clock frequency. The signal output from the 0 insertion circuit 1*a* is input into a series circuit of delay elements 1*b*, 1*c*, 1*d*, 1*e*, 1*f*. Outputs of the delay elements 1*b*, 1*c*, 1*d*, 1*e*, 1*f* are multiplied by coefficients from a coefficient memory 1*m* by multipliers 1*g*, 1*h*, 1*i*, 1*j*, 1*k*, respectively. Multiplication results are synthesized by a synthesis circuit 11, and input into a sample circuit 1*n*. The sample circuit 1*n* outputs the R' signal in a phase in which the R' signal should exist.

Since the G signal processing circuit 402 and the B signal processing circuit 403 also have the same constitution as that of the R signal processing circuit 401, specific description will be omitted. In the G signal processing circuit 402, a synthesized output from a synthesis circuit 21 is input into a sample circuit 2*n*. The sample circuit 2*n* outputs the G signal in a phase in which the G signal should exist. In the B signal processing circuit 403, a synthesized output from a synthesis circuit 31 is input into a sample circuit 3*n*. The sample circuit 3*n* outputs the B' signal in a phase in which the B' signal should exist.

Figure 5:
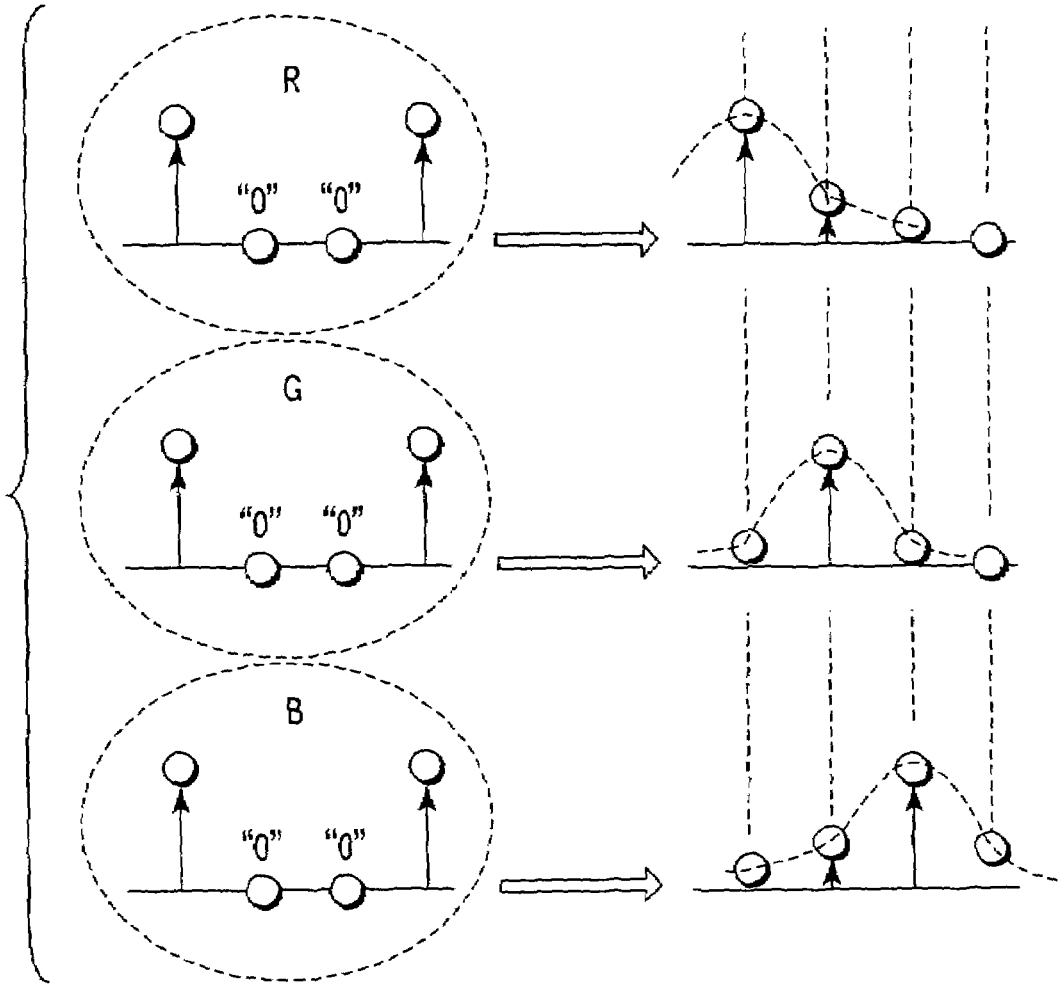
FIG. 5 is an operation explanatory view showing an operation of the circuit of FIG. 4.

FIG. 5 shows a behavior in processing sample data in order to describe the filtering in the respective signal processing circuits 401, 402, 403. Between the samples of the R signal, 0 is inserted at a phase interval of 120 degrees. When this R signal is filtered as described above, the signal is gain-controlled, and also phase-controlled by setting of a coefficient value. The G and B signals are similarly gain-controlled and phase-controlled. Moreover, when output timings (phases) of the R', G, and B' signals are set in the sample circuits 1*n*, 2*n*, 3*n*, series RGB signals can be obtained in the same manner as in the above-described embodiment.

Also with respect to this filter output, a gain control circuit may be disposed in order to obtain a balance among RGB.

Figure 6:
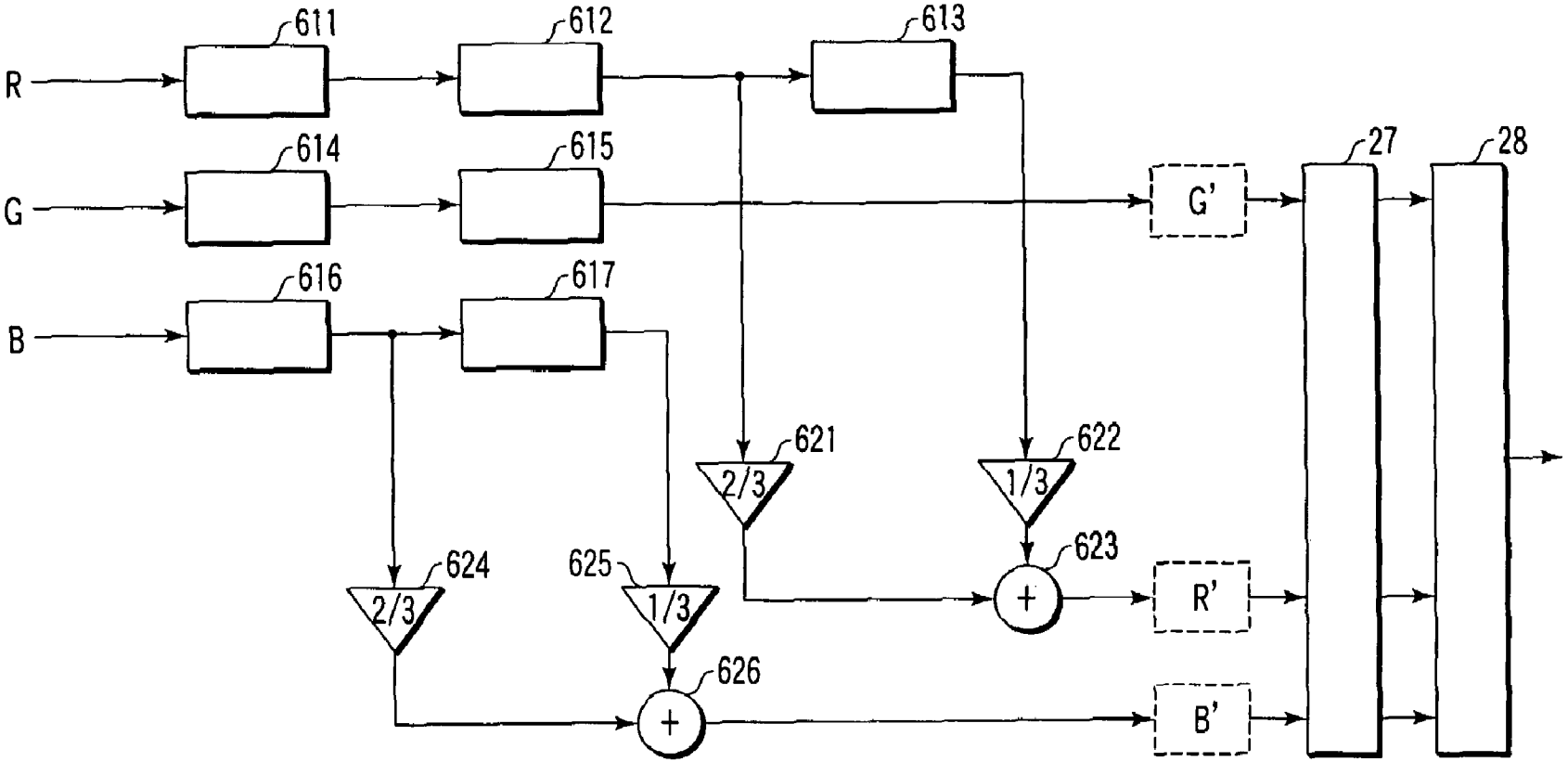
FIG. 6 is a diagram showing a constitution example of still another embodiment of the interpolation circuit of FIG. 2.

FIG. 6 shows another embodiment of the present invention. The circuit shown in FIG. 2 is adapted to the pixel arrangement of G, R, B, G, R, B, . . . , but the embodiment shown in FIG. 6 is adapted to the pixel arrangement of R. G, B, R, G, B, . . .

An R signal is input into a series circuit of delay elements 611, 612, 613. A G signal is input into a series circuit of delay elements 614, 615. A B signal is input into a series circuit of delay elements 616, 617. After the signals on input and output sides of the delay element 613 are gain-controlled by coefficient units 621, 622, respectively, the signals are added up by an adder 623, and input into a balance adjustment circuit 27. An output of the delay element 615 is directly input into the balance adjustment circuit 27. After the signals on the input and output sides of the delay element 617 are gain-controlled by coefficient units 624, 625, the signals are added up by an adder 626, and input into the balance adjustment circuit 27.

Three signals R', G', B' are selected and output in order by a selector 28, and output as series RGB signals. Also in this circuit, results similar to those of the processing described with reference to FIGS. 2, 3 can be obtained.

The present invention is not limited to the above-described embodiment. The coefficient values at a time when the R' and B' signals are obtained are not limited to the above-described values. The coefficient values may be arbitrarily changed depending on the pixel arrangement of the display region. Furthermore, the coefficient values may be switched depending on the pixel arrangement or a scanning direction. In the above description, the G signal is regarded as the reference, but the present invention is not limited to this, and, needless to say, the R or B signal may be used as the reference.

In the example of FIG. 3, scanning is performed from left to right, and the pixels are arranged in order of R, G, B. However, the scanning is sometimes performed from right to left. In this case, the pixels are arranged in order of B, G, R. In this case, the respective pixels are subjected to an operation shown in FIG. 7.

Figure 7:
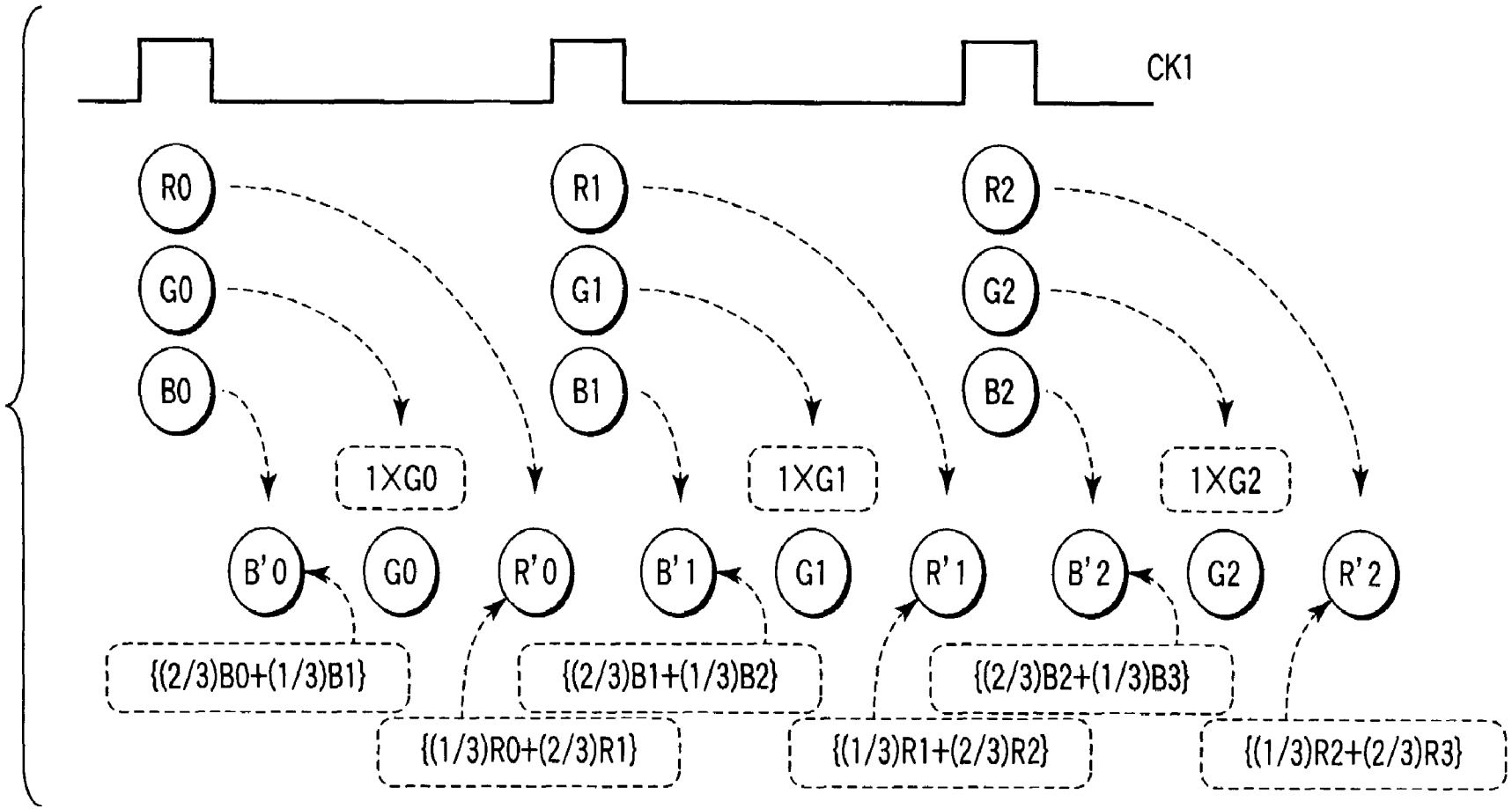
FIG. 7 is a diagram showing a constitution example of still another embodiment of the interpolation circuit of FIG. 2.

When the calculation formulas of FIG. 3 are compared with those of FIG. 7, it is possible to construct a device which can cope with both of the scanning from left to right and that from right to left.

As one of methods, there is a method capable of switching the coefficient with respect to the pixel. That is, the method is constituted in such a manner as to obtain both of the calculation formulas of FIGS. 7 and 3.

Figure 8A:
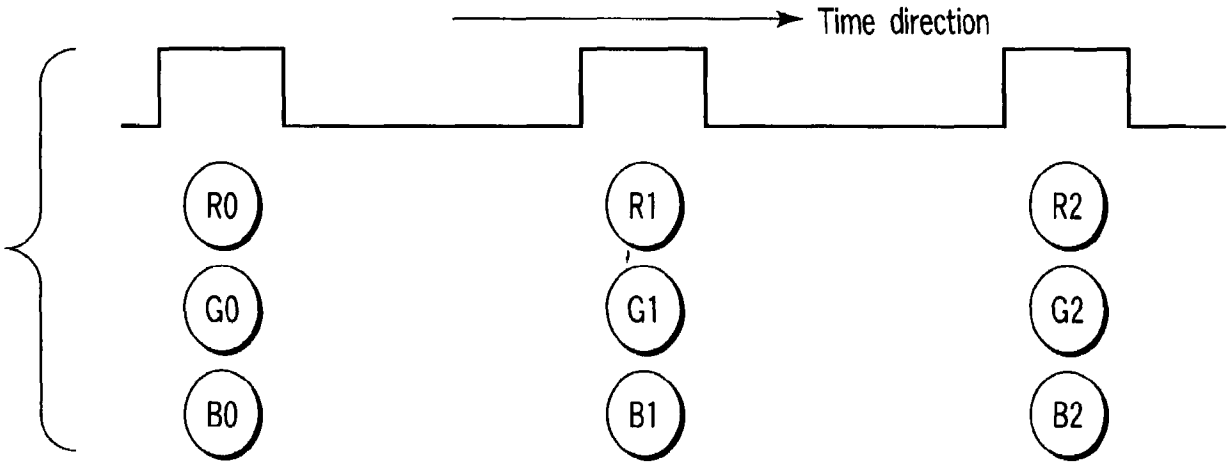
FIGS. 8A, 8B are explanatory views showing still another embodiment of the unit according to the present invention.
Figure 8B:
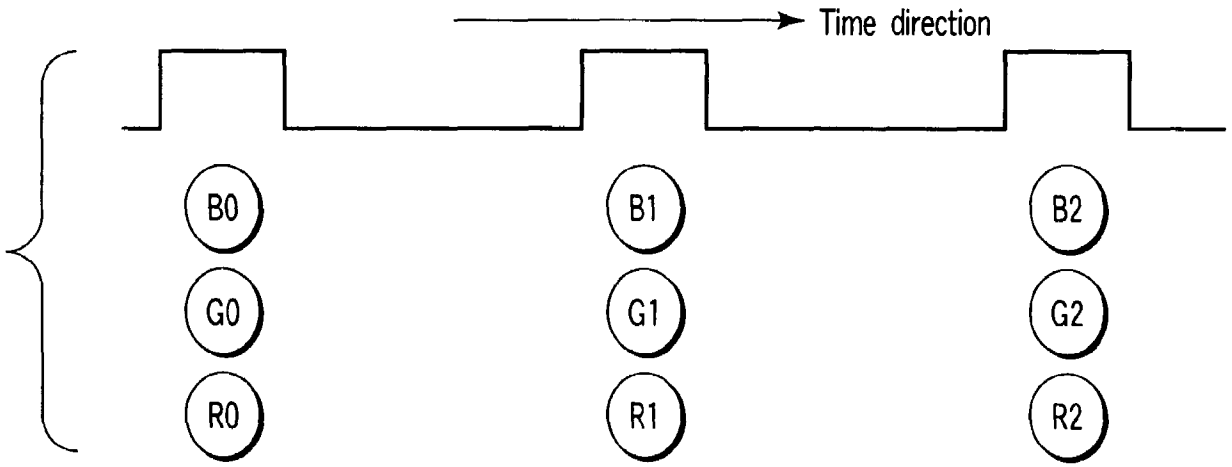

A second method is constituted in such a manner as to switch the arrangement of the pixels to be input into the interpolation circuit 212. For this method, for example, an input section of the circuit shown in FIG. 2B is provided with a switch circuit. Moreover, arranged states of R and B series shown in FIG. 8A can be replaced with those of R and B series shown in FIG. 8B. In this case, it is possible to obtain a circuit capable of coping with both of a panel to be scanned from left to right and a panel to be scanned from right to left.

Furthermore, a third method may be used in which there are disposed a plurality of circuits required in the opposite scanning directions, and outputs of the plurality of circuits are arbitrarily selected.

The present invention is not limited to the above-described embodiments.

Figure 9:
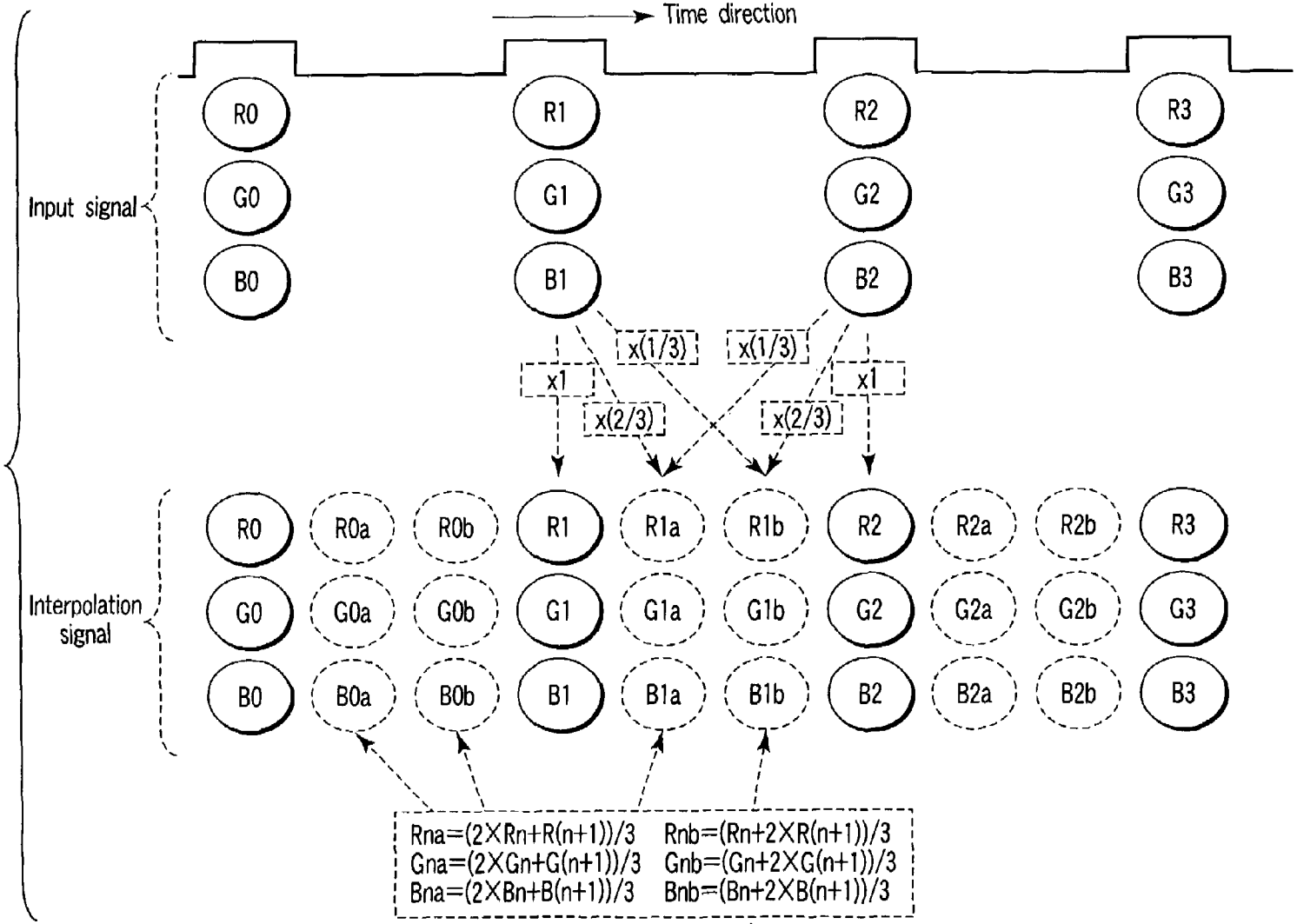
FIG. 9 is an explanatory view showing interpolation in still another embodiment of the unit according to the present invention.

FIG. 9 and subsequent figures are explanatory views of still another embodiment of the present invention. The following embodiment has a constitution in which the above-described embodiment includes a superior function. First, a technical background of the following embodiment will be described.

In the examples of the above-described embodiment (FIGS. 2, 3, 4), the pixel (referred to also as video) obtained by linear interpolation decays in a high range, but the pixel (video) which is not interpolated does not decay in the high range. That is, the R', B+ signals are suppressed or decayed in a high-range frequency, but the G signal is not decayed in the high-range frequency. As a result, it is seen that the video has a tendency to come close to green as the video signal approaches the high-range frequency. That is, color reproducibility degrades at the high-range frequency.

To solve the problem, in the following embodiment, the respective R, G, B signals are processed in such a manner as to be equally high-range limited. That is, the G signal is also decayed in the high range in the same manner as in the high-range decay of the R and B signals by the linear interpolation. That is, the G signal is extracted via a low pass filter in the interpolation circuit 212.

A state in which the R, G, B signals are linearly interpolated will be described with reference to FIG. 9. In FIG. 9, input signals are shown in an upper stage, and interpolation signals are shown in a lower stage. As to three-color simultaneous input signals (R0, G0, B0), (R1, G1, B1), (R2, G2, B2), . . . , color signals are converted into three-times frequency sample signals as shown in the lower stage. That is, the R signal is converted into R0, R0*a*, R0*b*, R1, R1*a*, R1*b*, R2, R2*a*, R2*b*, . . . in a time direction, the G signal is converted into G0, G0*a*, G0*b*, G1, G1*a*, G1*b*, G2, G2*a*, G2*b*, . . . in the time direction, and the B signal is converted into B0, B0*a*, B0*b*, B1, B1*a*, B1*b*, B2, B2*a*, B2*b*, . . . in the time direction. Here, the respective R, G, B signals in positions surrounded with dotted lines of the figure are represented as follows:

$$Rna=(2\times Rn+R(n+1))/3;$$

$$Gna=(2\times Gn+G(n+1))/3;$$

$$Bna=(2\times Bn+B(n+1))/3;$$

$$Rnb=(Rn+2\times R(n+1))/3;$$

$$Gnb=(Gn+2\times G(n+1))/3; \text{ and}$$

$$Bnb=(Bn+2\times B(n+1))/3.$$

In the first embodiment, as shown in FIG. 3, the followings are selected:

$$R'0=(2\times R0+R(0+1))/3;$$

$$G'0=G0;$$

$$B'0=(2\times B0+B(0+1))/3;$$

$$R'1=(2\times R1+R(1+1))/3;$$

$$G'1=G1;$$

$$B'1=(2\times B1+B(1+1))/3;$$

$$R'1=(2\times R2+R(2+1))/3;$$

$$G'1=G2; \text{ and}$$

$$B'1=(2\times B2+B(2+1))/3.$$

Therefore, as to the G signal, a high-range component is maintained as it is.

Figure 10:
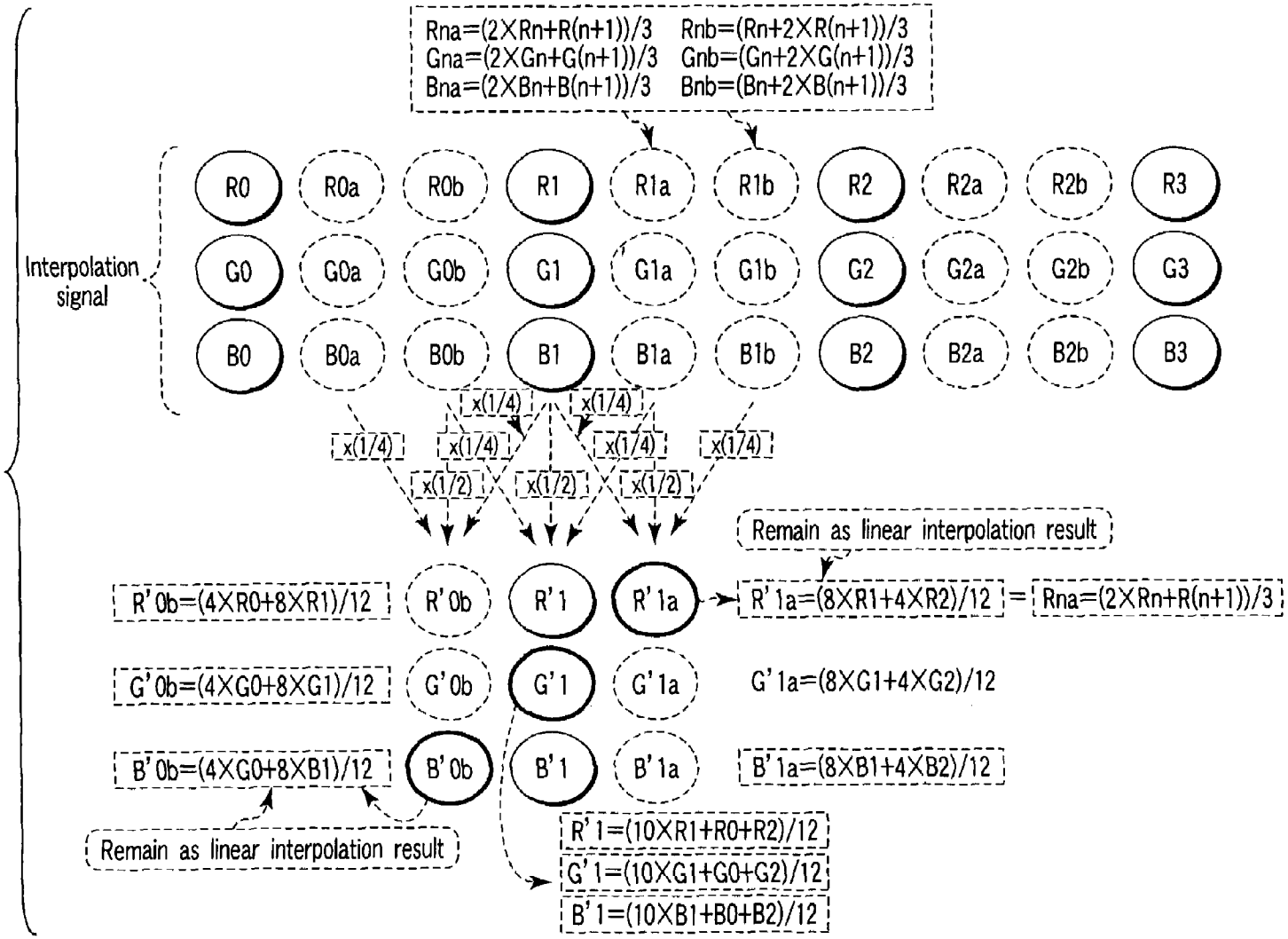
FIG. 10 is an explanatory view continued from FIG. 9.

In the present embodiment, the color signal is further filtered as shown in FIG. 10. That is, an upper stage shows the same interpolation signal as that of the lower stage of FIG. 9. An operation is performed as follows in a case where this interpolation signal is multiplied by a coefficient to obtain a secondary interpolation signal.

That is, the following calculations are performed in a case where signals R'0*b*, G'0*b*, B'0*b* of FIG. 10 are obtained:

$$R'0b=((R0a)/4)+((R0b)/2)+(R1)/4;$$

$$G'0b=((G0a)/4)+((G0b)/2)+(G1)/4; \text{ and}$$

$$B'0b=((B0a)/4)+((B0b)/2)+(B1)/4.$$

Moreover, the following calculations are performed in a case where signals R'1, G'1, B'1 of FIG. 10 are obtained:

$$R'1=((R0b)/4)+((R1)/2)+(R1a)/4;$$

$$G'1=((G0b)/4)+((G1)/2)+(G1a)/4; \text{ and}$$

$$B'1=((B0b)/4)+((B1)/2)+(B1a)/4.$$

Furthermore, the following calculations are performed in a case where signals R'1*a*, G'1*a*, B'1*a* of FIG. 10 are obtained:

$$R'1a=((R1)/4)+((R1a)/2)+(R1b)/4;$$

$$G'1a=((G1)/4)+((G1a)/2)+(G1b)/4; \text{ and}$$

$$B'1a=((B1)/4)+((B1a)/2)+(B1b)/4.$$

It is assumed that B'0*b*, G'1, R'1*a* are adopted among the above-described calculation results. These signals are as follows:

$$B'0b=(4\times B0+8\times B1)/12;$$

$$G'1=(10\times G1+G0+G2)/12; \text{ and}$$

$$R'1a=(8\times R1+4\times R2)/12.$$

In a case where this formula is noted, B'0*b* turns to: B'9*b*=((B0+2×B1)/3). This has the same contents as those of Bnb=(Bn+2×B(n+1))/3 described with reference to FIGS. 3 and 9.

Moreover, R'1*a* turns to:

R'1a=(2×R1+R2)/3. This has the same contents as those of: Rna=(2×Rn+R(n+1))/3 described with reference to FIGS. 3 and 9.

On the other hand, with respect to G71=G1 described with reference to FIGS. 3 and 9, G'1 is:

$$G'1=(10\times G1+G0+G2)/12, \text{ and filtered.}$$

Therefore, when an interpolated output is subjected to secondary filtering as shown in FIG. 10, the G signal can have high-range characteristics similar to those of the R, B signals. That is, picture quality degradation is inhibited such as a picture which becomes greenish in the high range of the video signal.

Figure 11A:
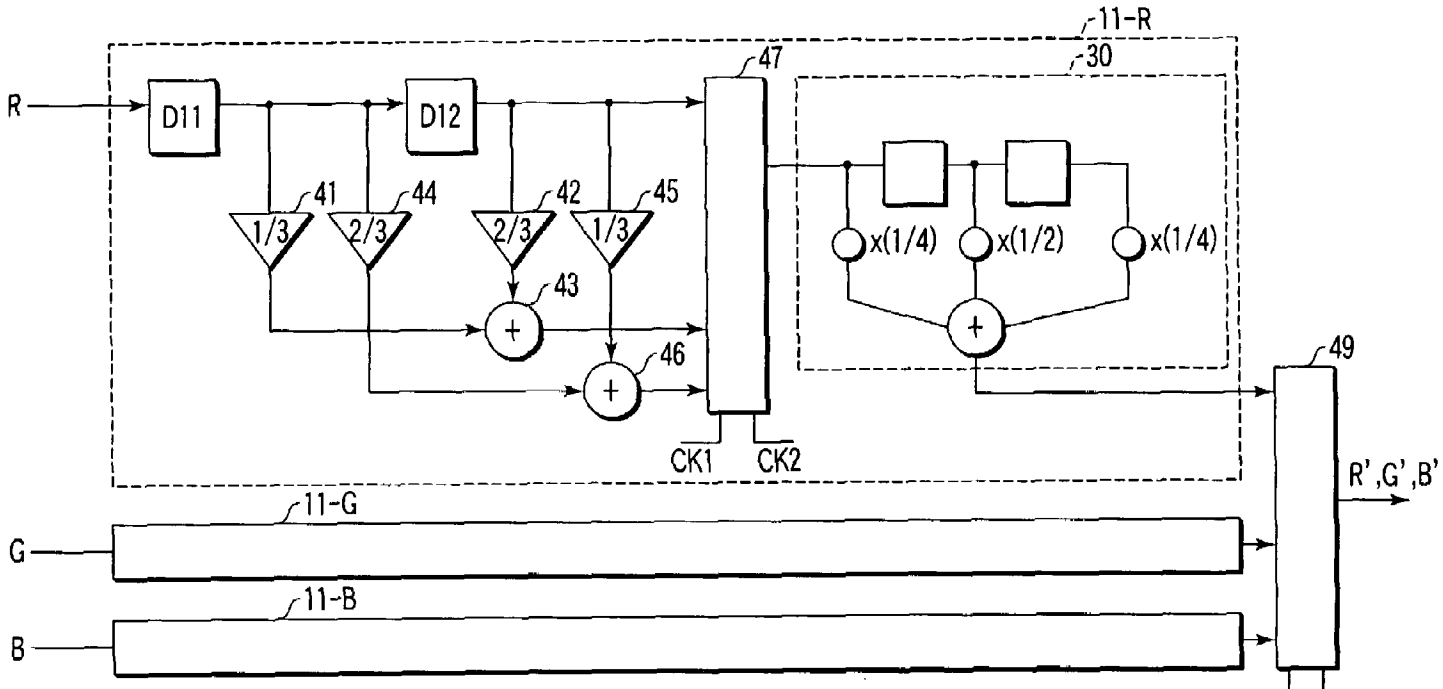
FIGS. 11A, 11B are explanatory views showing another embodiment and an operation of the unit according to the present invention which executes the interpolation of FIGS. 9, 10.

FIG. 11A shows a circuit constitution example for realizing the interpolation described with reference to FIG. 10.

Since an R signal processing circuit 11-R, a G signal processing circuit 11-G, and a B signal processing circuit 11-B have the same constitution, the R signal processing circuit 11-R only will be representatively described in detail.

An R signal is input into a series circuit of delay elements D11, D12. After outputs of the delay elements D11, D12 are amplified by coefficient units 41, 42, respectively, they are added up by an adder 43, and input into a sampling circuit (parallel serial converter) 47 provided with a phase adjusting function. After the outputs of the delay elements D11, D12 are amplified by coefficient units 44, 45, respectively, they are added up by an adder 46, and input into the sampling circuit (parallel serial converter) 47 provided with the phase adjusting function. An output of the sampling circuit 47 provided with the phase adjusting function is input into a filtering circuit 30.

Figure 11B:
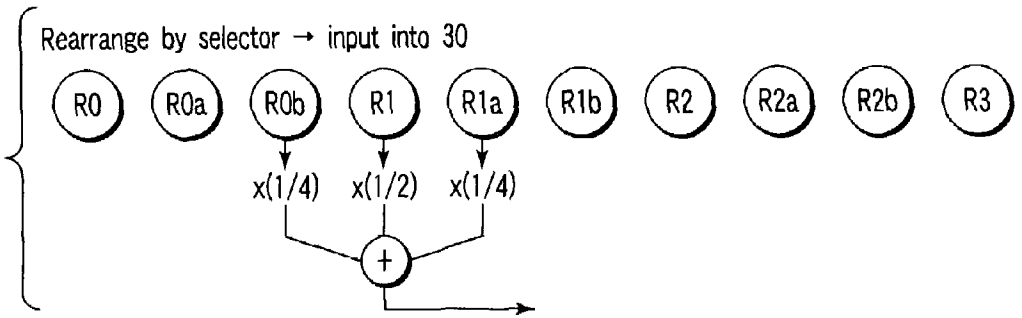

The outputs of the sampling circuit 47 provided with the phase adjusting function are arranged as shown in FIG. 11B, and input into the filtering circuit 30. For example, the filtering circuit 30 multiplies three sample outputs by coefficients (¼), (½), (¼), and adds up multiplied outputs to obtain final outputs. The data is obtained from this filtering circuit 30 as shown in FIG. 10. Outputs of the respective R signal processing circuit 11-R, G signal processing circuit 11-G, and B signal processing circuit 11-B are input into a selector 49.

Figure 12:
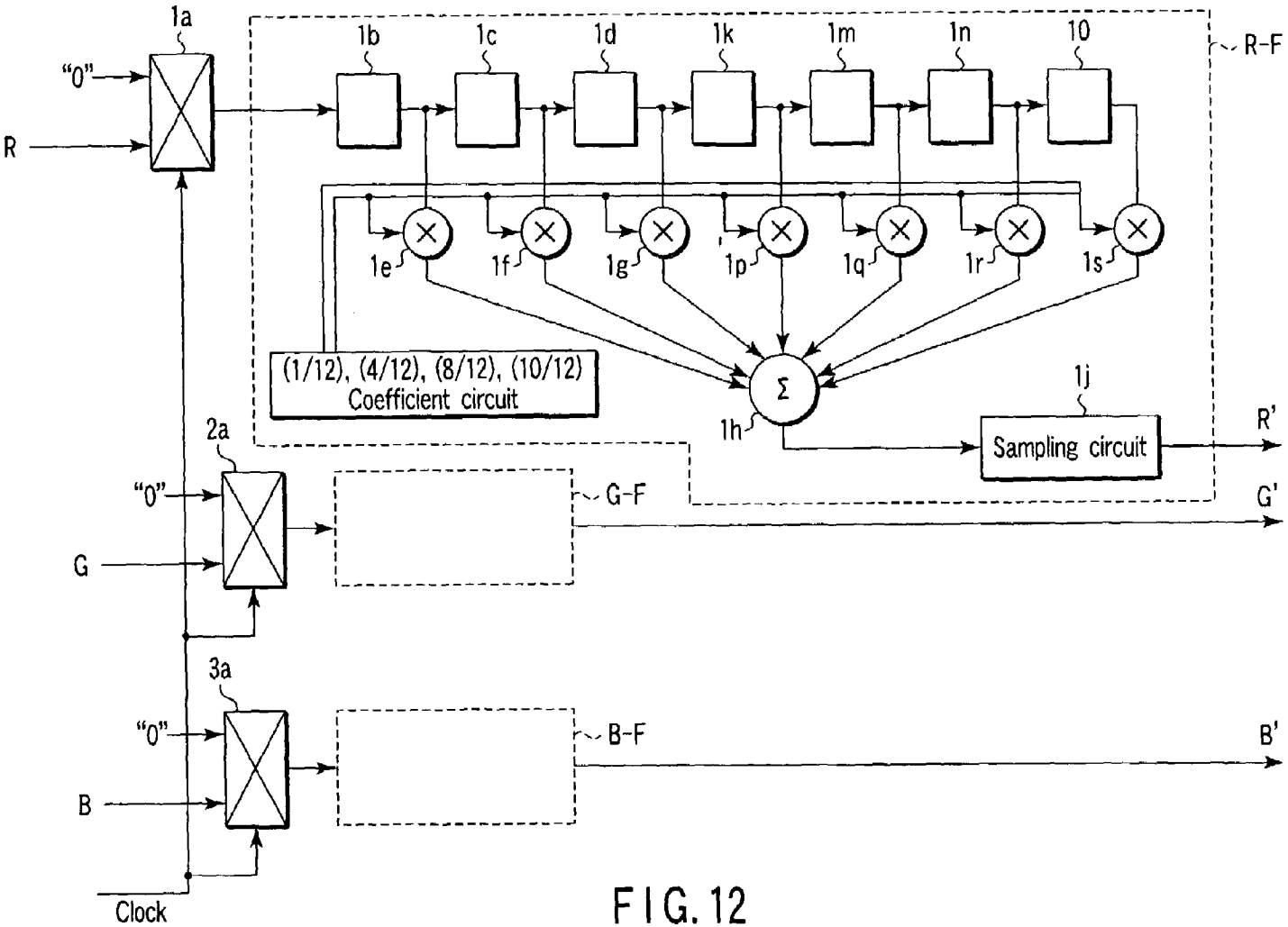
FIG. 12 is an explanatory view showing still another embodiment of the unit according to the present invention.

FIG. 12 shows still another embodiment of the present invention. This embodiment is different from that shown in FIG. 4 in that delay elements of a filtering section R-F increase, and different in coefficients. That is, delay elements 1*b*, 1*c*, 1*d*, 1*k*, 1*m*, 1*n*, 1*o* are connected in series. Outputs of the respective delay elements 1*b*, 1*c*, 1*d*, 1*k*, 1*m*, 1*n*, 1*o* are supplied to multipliers 1*e*, 1*f*, 1*g*, 1*p*, 1*q*, 1*r*, 1*s*. Moreover, coefficients (1/12), (4/12), (8/12), (10/12), (8/12), (4/12), (1/12) are input into the multipliers 1*e*, 1*f*, 1*g*, 1*p*, 1*q*, 1*r*, 1*s*. Outputs of the multipliers 1*e*, 1*f*, 1*g*, 1*p*, 1*q*, 1*r*, 1*s* are input into a synthesis circuit 1*h*, and synthesized. An output of the synthesis circuit 1*h* is input into a sampling circuit 1*j*. In the sampling circuit 1*j*, data of an R signal is sampled and derived.

Even in a processing system of a G signal, a filtering section G-F having the same constitution as that of the filtering section R-F is disposed in a rear stage of a 0 insertion circuit 2*a*. Even in a processing system of a B signal, a filtering section B-F having the same constitution as that of the filtering section R-F is disposed in a rear stage of a 0 insertion circuit 3*a*.

Figure 13:
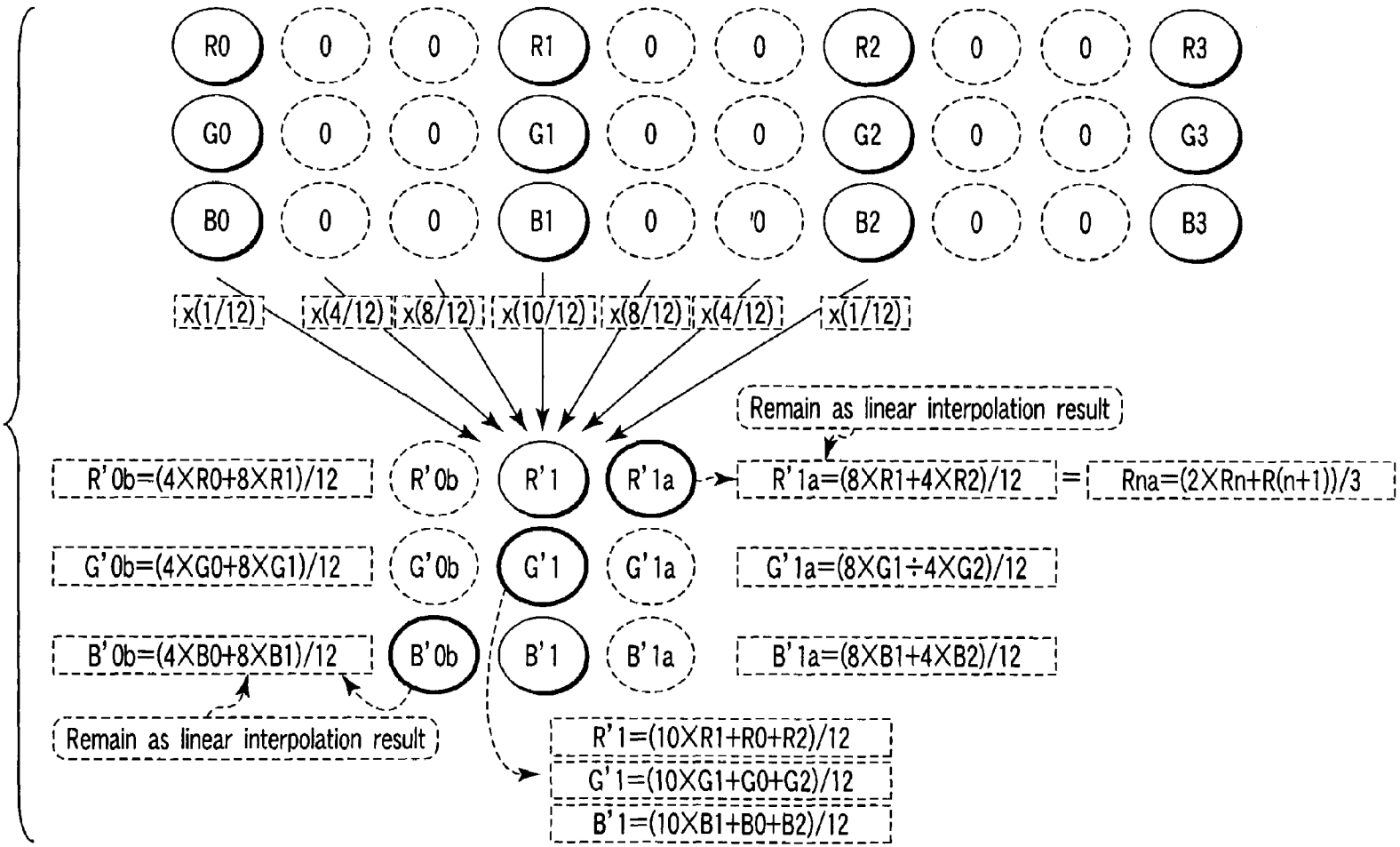
FIG. 13 is an explanatory view showing an interpolating operation of the unit of FIG. 12.

FIG. 13 is an explanatory view showing an operation of the above-described embodiment of FIG. 12. Zero is inserted among R0, R1, R2, . . . , and there is made an arrangement of R0, 0, 0, R1, 0, 0, R2, 0, 0, R3, 0, 0, . . . in a time direction. As to a G signal, there is made an arrangement of G0, 0, 0, G1, 0, 0, G2, 0, 0, G3, 0, 0, . . . in the time direction. As to a B signal, there is made an arrangement of B0, 0, 0, B1, 0, 0, B2, 0, 0, B3, 0, 0, . . . in the time direction.

Here, when the G signal is regarded as a central phase, the B signal is utilized as a signal in a phase position which is one clock before the central position, and the R signal is utilized as a signal in a phase position which is one clock after the central position. Filtering results of the respective signals are as shown by signals surrounded with bold lines and corresponding numerical formulas in FIG. 13. As apparent from the numerical formulas, the filtering results with respect to the R, B signals are the same as the above-described operation results. With regard to the G signal, a result of (10×G1+G0+G2)/12 is obtained for G'1. Even in the above-described embodiment, the same effect as that of the embodiment shown in FIG. 11 is obtained.

Figure 14:
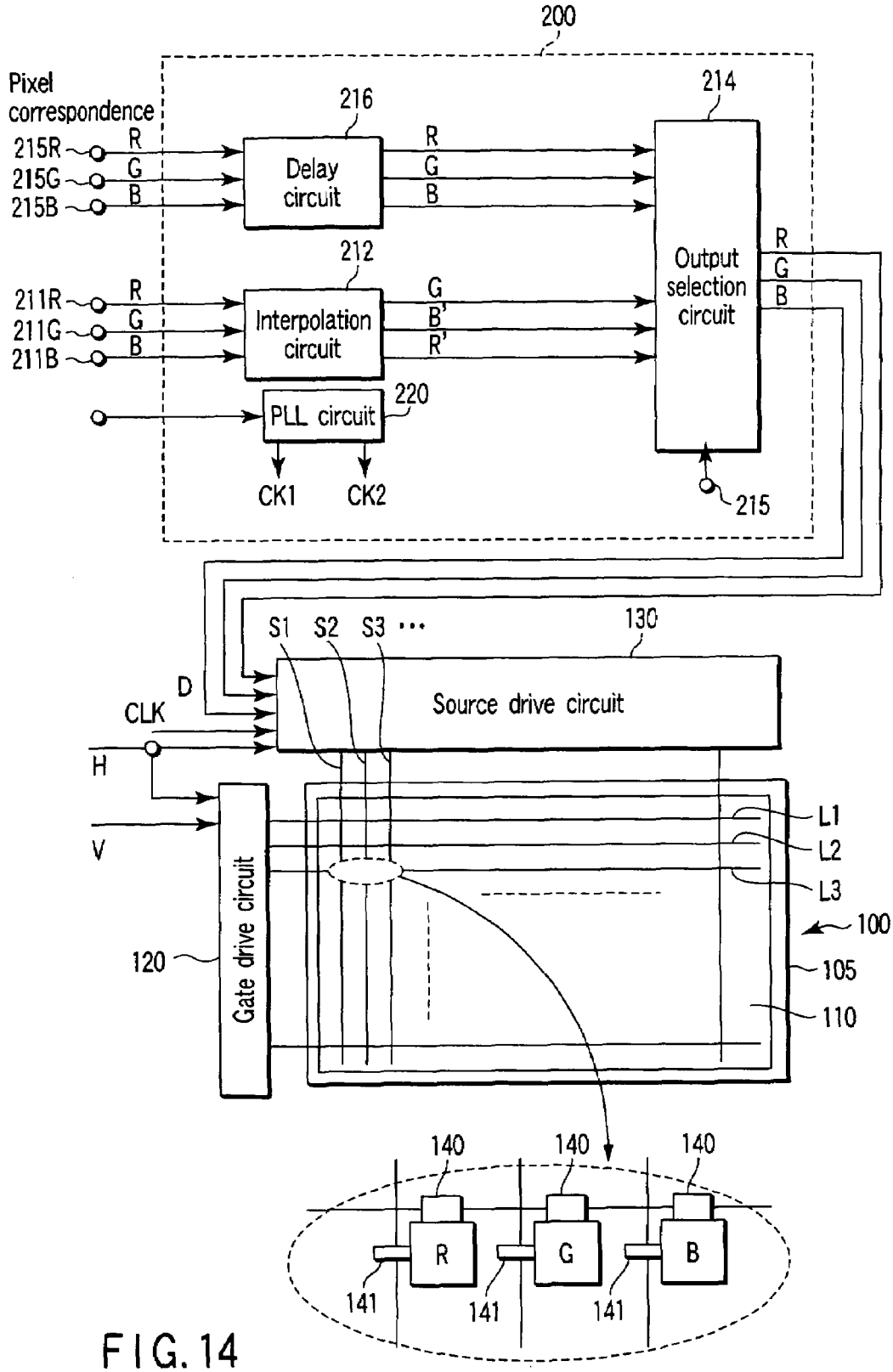
FIG. 14 is an explanatory view showing a constitution example of a flat display unit in still another embodiment of the present invention.

FIG. 14 shows still another embodiment of the constitution shown in FIG. 1. The same circuit constitution as that shown in FIG. 1 is denoted with the same reference numerals, and description thereof is omitted. In FIG. 1, the output terminal of the interpolation circuit 212 is connected to the signal selection circuit 213. In the present embodiment, the signal selection circuit 213 is included in the interpolation circuit 212, and an input terminal 217 for switching an output of the interpolation circuit 212 is newly connected to the interpolation circuit 212.

R, G, B input video signals are supplied to input terminals 211R, 211G, 211B. The input video signals are supplied to the interpolation circuit 212. As described above, the interpolation circuit 212 outputs a first color signal (e.g., G), a first interpolation color signal (e.g., B'), and a second interpolation color signal (e.g., R'). The first color signal (G), the first interpolation color signal (B'), and the second interpolation color signal (R') are input into an output selection circuit 214.

The input video signals R, G, B corresponding to a pixel arrangement may be directly input into the output selection circuit 214 via a delay circuit. 216. This system is disposed in order to obtain flexibility in consideration of a case where the input video signals corresponding to a color pixel arrangement of a display region are input.

The output selection circuit 214 selects either of a direct signal from the delay circuit 216 and an output signal from the interpolation circuit 212 to supply the signal to a source drive circuit 130. A selection signal supplied to a terminal 215 may be input by a user if necessary, or automatically input. In the automatic input, a circuit is disposed which judges whether or not the input video signal is of a pixel correspondence type.

The first color signal (G), the first interpolation color signal (B'), and the second interpolation color signal (R') output from the output selection circuit 214 are input into corresponding shift registers for R, G, B of the source drive circuit 130.

Reference numeral 220 denotes a phase lock loop circuit which generates clocks CK1, CK2 in synchronization with a synchronizing signal synchronized with the input video signal. Here, various types of timing pulses are generated, and utilized by the respective circuits.

Figure 15A:
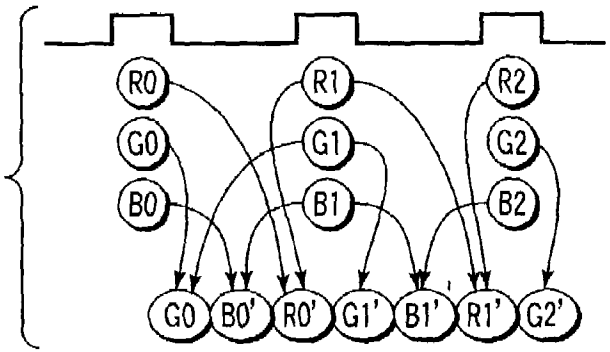
FIGS. 15A, 15B are explanatory views showing an operation and a specific constitution example of the interpolation circuit in still another embodiment of the unit of the present invention.
Figure 15B:
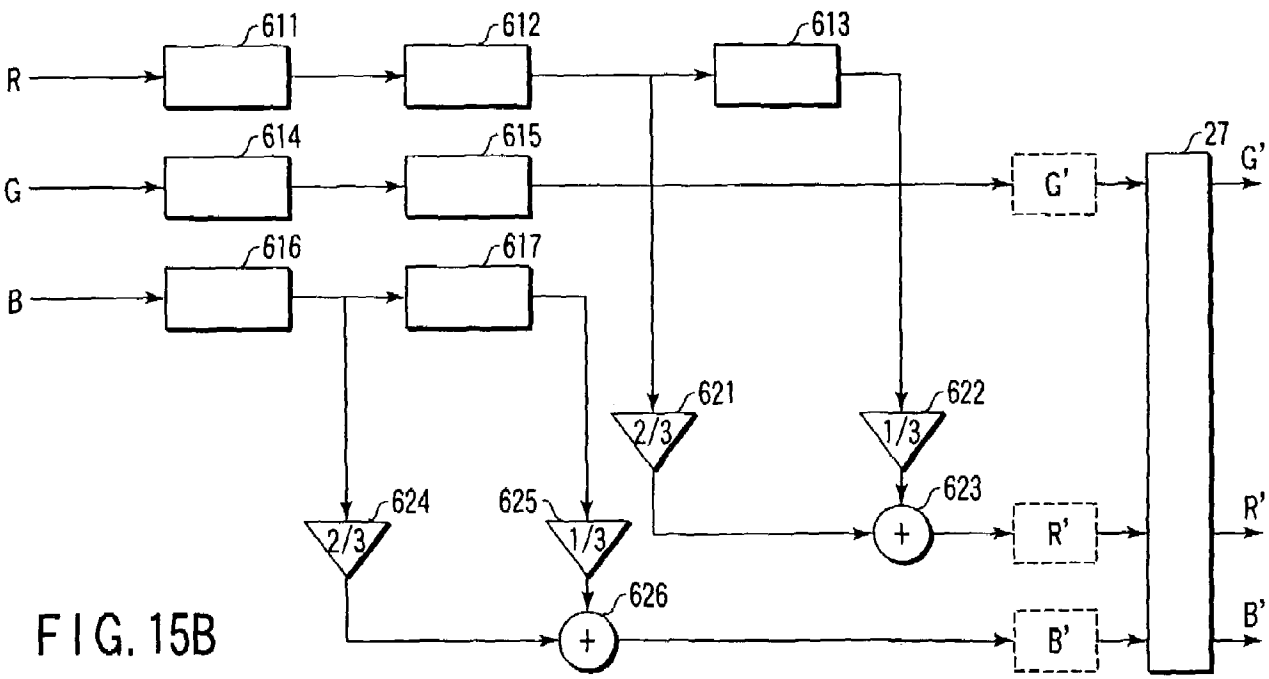

FIG. 15A shows a behavior in processing the pixel arrangement in order to describe still another embodiment of the present invention. Moreover, FIG. 15B shows a circuit for realizing this pixel arrangement processing, and shows a modification of the constitution shown in FIG. 6. The same circuit constitution as that shown in FIG. 6 is denoted with the same reference numerals, and the description is omitted. In FIG. 6, G, R', B' signals are input into a selector, and series RGB signals are arranged. However, since the series RGB signals do not necessarily have to be arranged, the selector may be omitted.

In this case, the G, R', B' signals are adjusted in respect of color balance by a balance adjustment circuit 27 having a gain control circuit, and R', G, B' signals are output in parallel. The R', G, B' signals are input into the corresponding registers for R, G, B of the source drive circuit 130.

Figure 16:
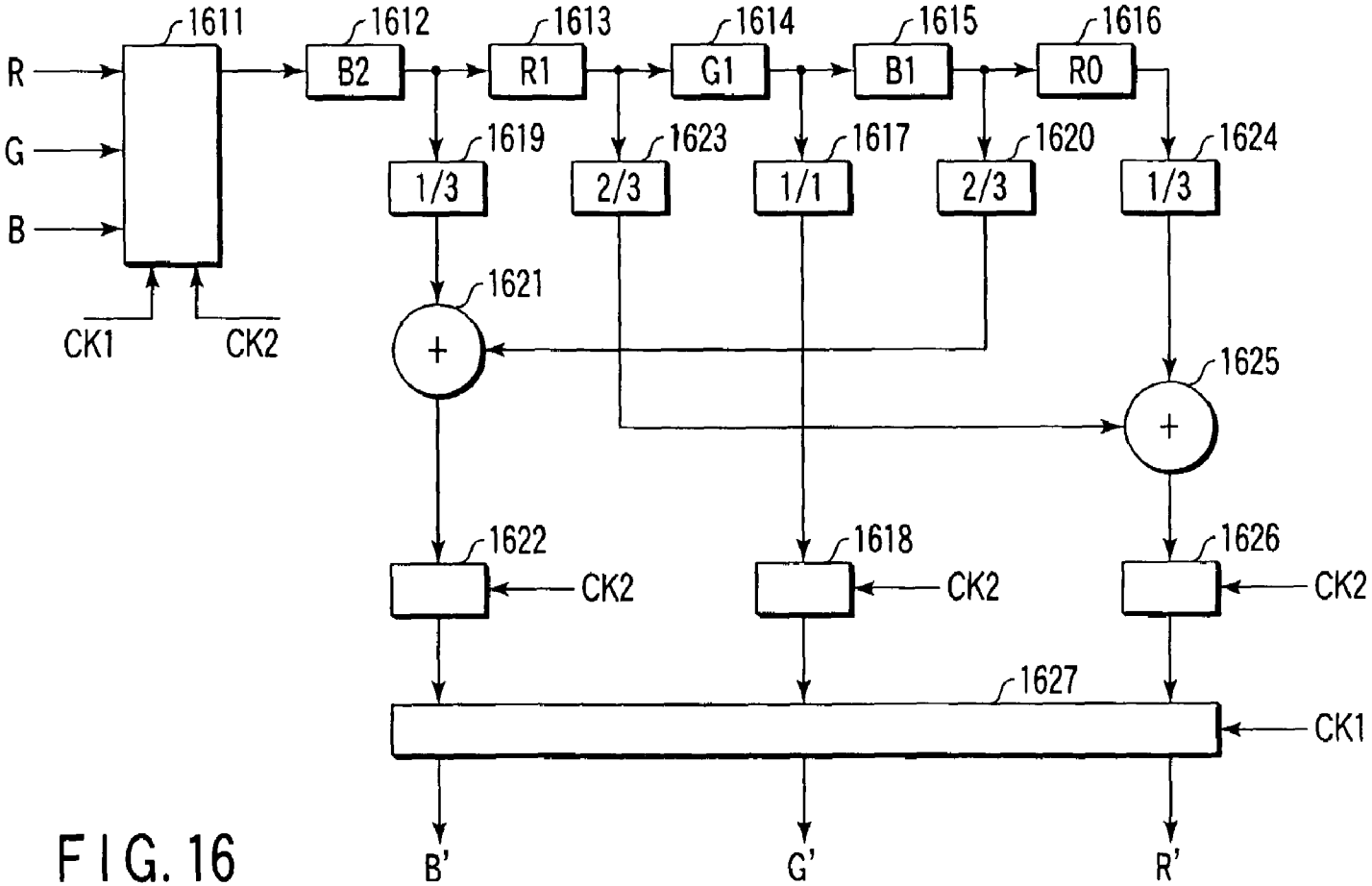
FIG. 16 is an explanatory view showing a constitution example of the interpolation circuit in still another embodiment of the unit of the present invention.

FIG. 16 shows still another embodiment of the present invention. A selector 1611 converts RGB signals input in parallel into series RGB signals in response to a clock CK2. An output of the selector 1611 is input into a series circuit of delay elements 1612 to 1616. Outputs of the delay elements 1612 and 1615 are amplified by coefficient units 1619, 1620, and input into an adder 1621. An output of the adder 1621 is input into a latch circuit 1627 via a delay element 1622 for timing adjustment.

Moreover, outputs of the delay elements 1613 and 1616 are amplified by coefficient units 1623, 1624, and input into an adder 1625. An output of the adder 1625 is input into the latch circuit 1627 via a delay element 1626 for timing adjustment.

Furthermore, an output of the delay element 1614 is input into a delay element 1618 via a coefficient unit 1617, and an output of the delay element 1618 is input into the latch circuit 1627.

Figure 17:
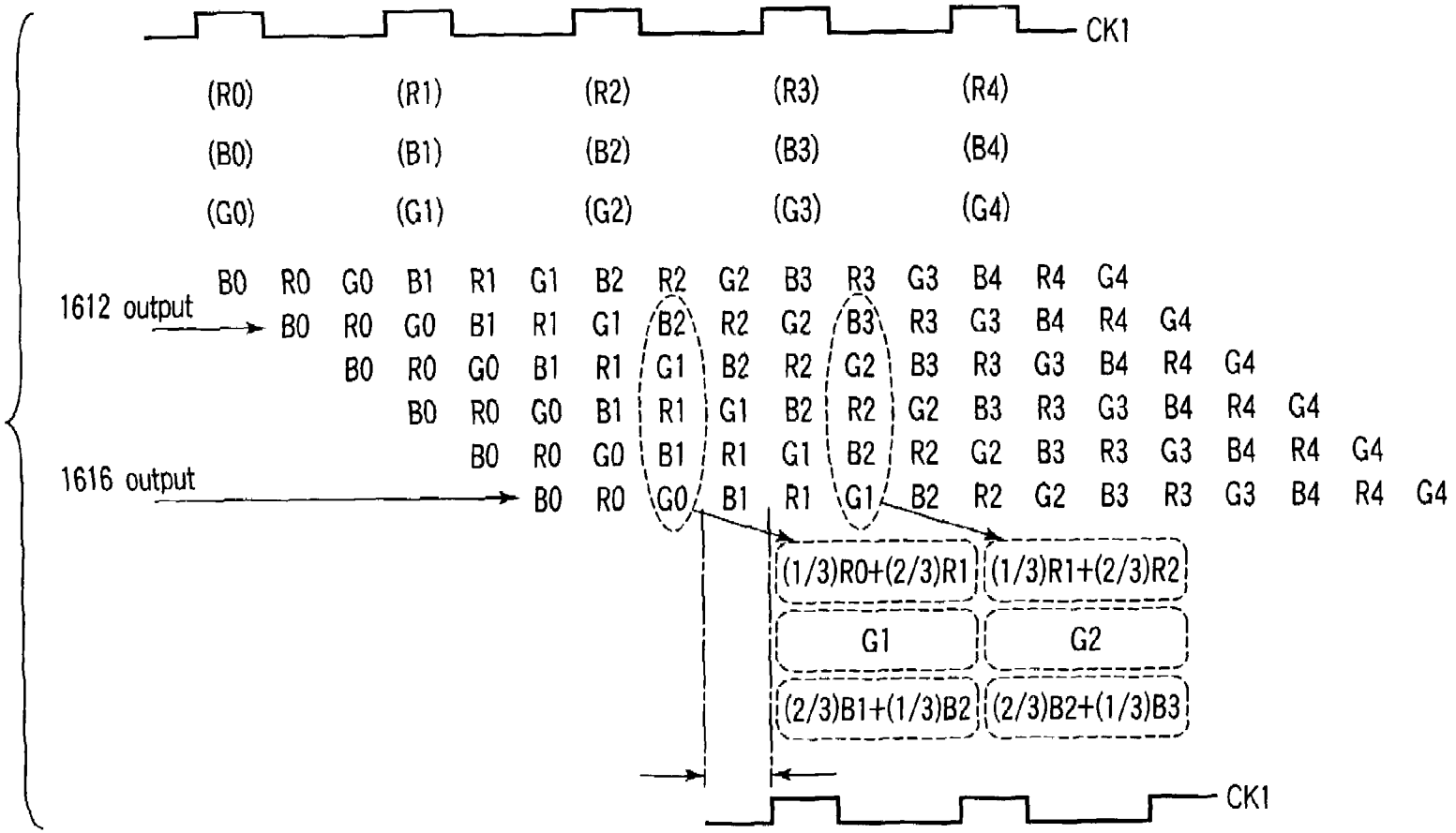
FIG. 17 is an explanatory view showing an operation of the circuit of FIG. 16.

FIG. 17 shows a state of the signal of each section in order to describe an operation of the circuit of FIG. 16. The RGB signals output from the selector 1611 are successively delayed by the delay elements 1612 to 1616. Among the outputs of the respective delay elements, signals surrounded with dotted lines in the figure are amplified by the coefficient units, and added up. Moreover, correction signals of RGB are extracted via the latch circuit 1627 at a sampling rate of the clock CK1.

Figure 18:
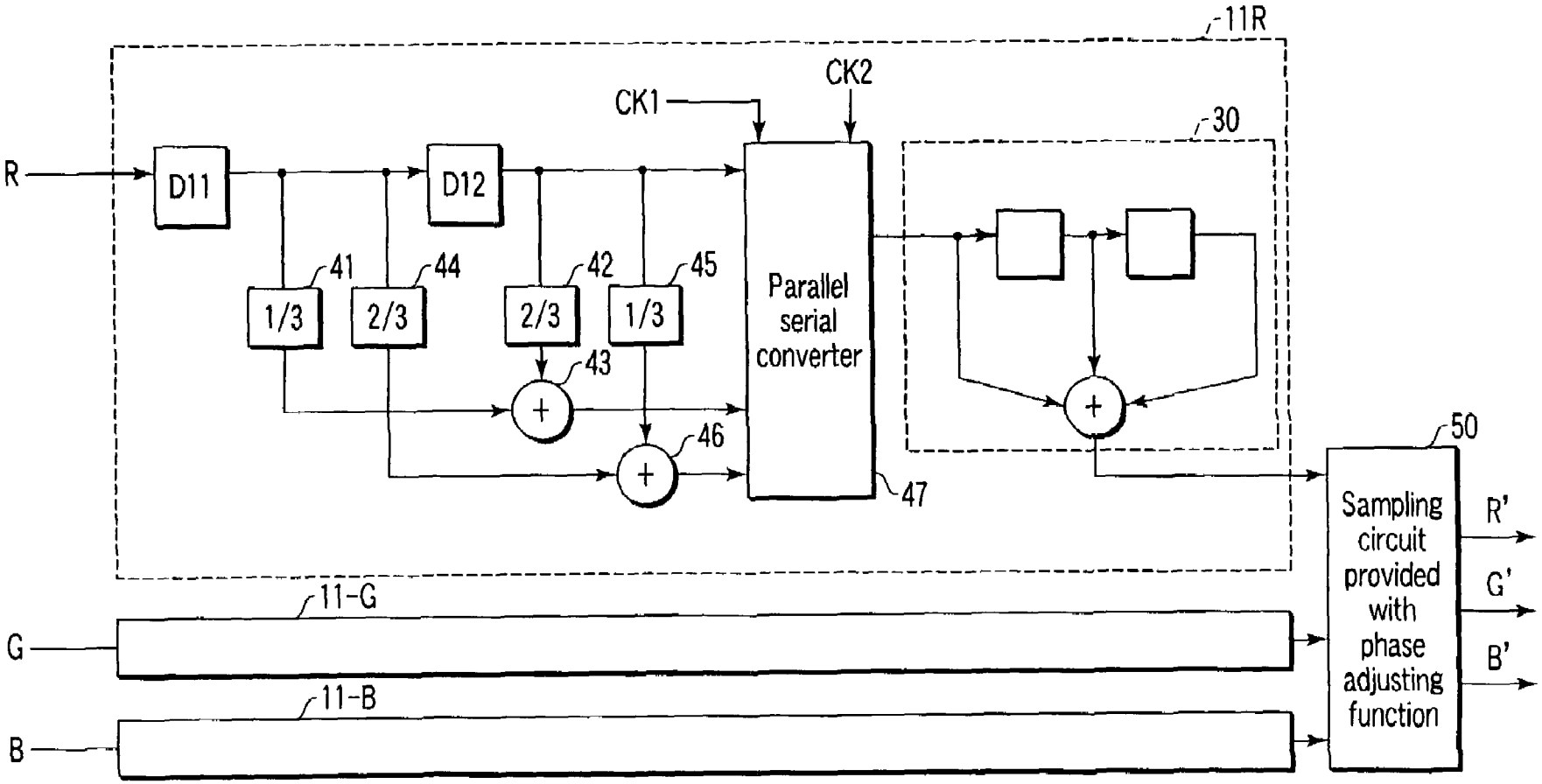
FIG. 18 is an explanatory view showing an operation and a specific constitution example of the interpolation circuit in still another embodiment of the unit of the present invention.

In a circuit shown in FIG. 11, the finally output RGB signals are converted in series unlike FIG. 18. In the embodiment of FIG. 18, finally output RGB signals are parallel to one another. A sampling circuit 50 provided with a phase adjusting function is a circuit which adjusts phases of signals in order to output the RGB signals in parallel. Since another part has the same constitution as that of FIG. 11, the same constitution as that of FIG. 11 is denoted with the same reference numerals, and description thereof is omitted.

Figure 19:
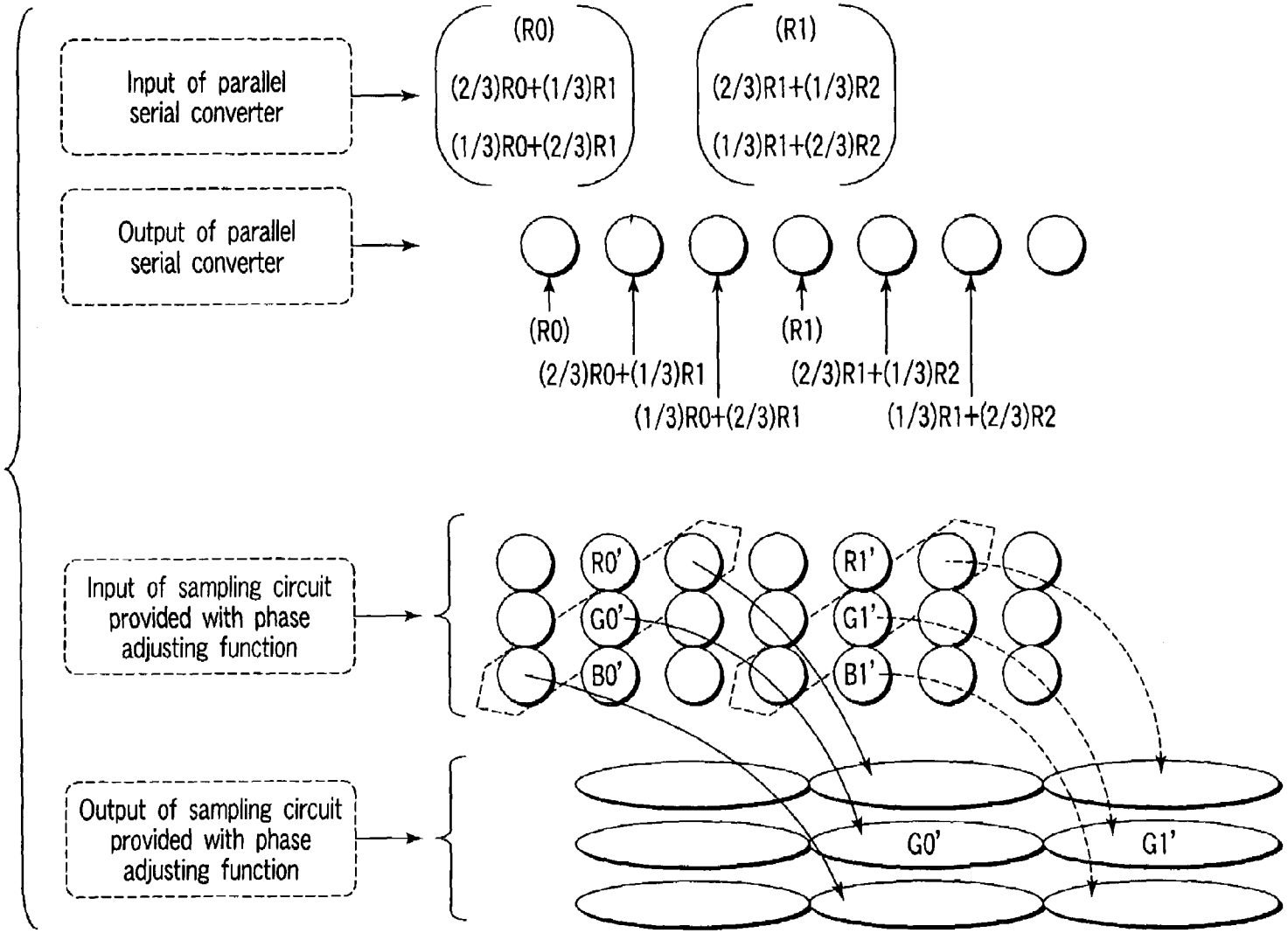
FIG. 19 is an explanatory view showing an operation of the circuit of FIG. 18.

FIG. 19 shows behaviors of input and output signals of a parallel serial converter 47 shown in FIG. 18. Three signals processed by coefficient units and adders are input into the parallel serial converter 47. These three signals are converted into series signals, and output. Moreover, the signals are filtered by a filtering circuit 30, and input into the sampling circuit 50 provided with the phase adjusting function. In the sampling circuit 50 provided with the phase adjusting function, an appropriate sample signal is extracted from the respective parallel input signals, and supplied to a source drive circuit.

Figure 20:
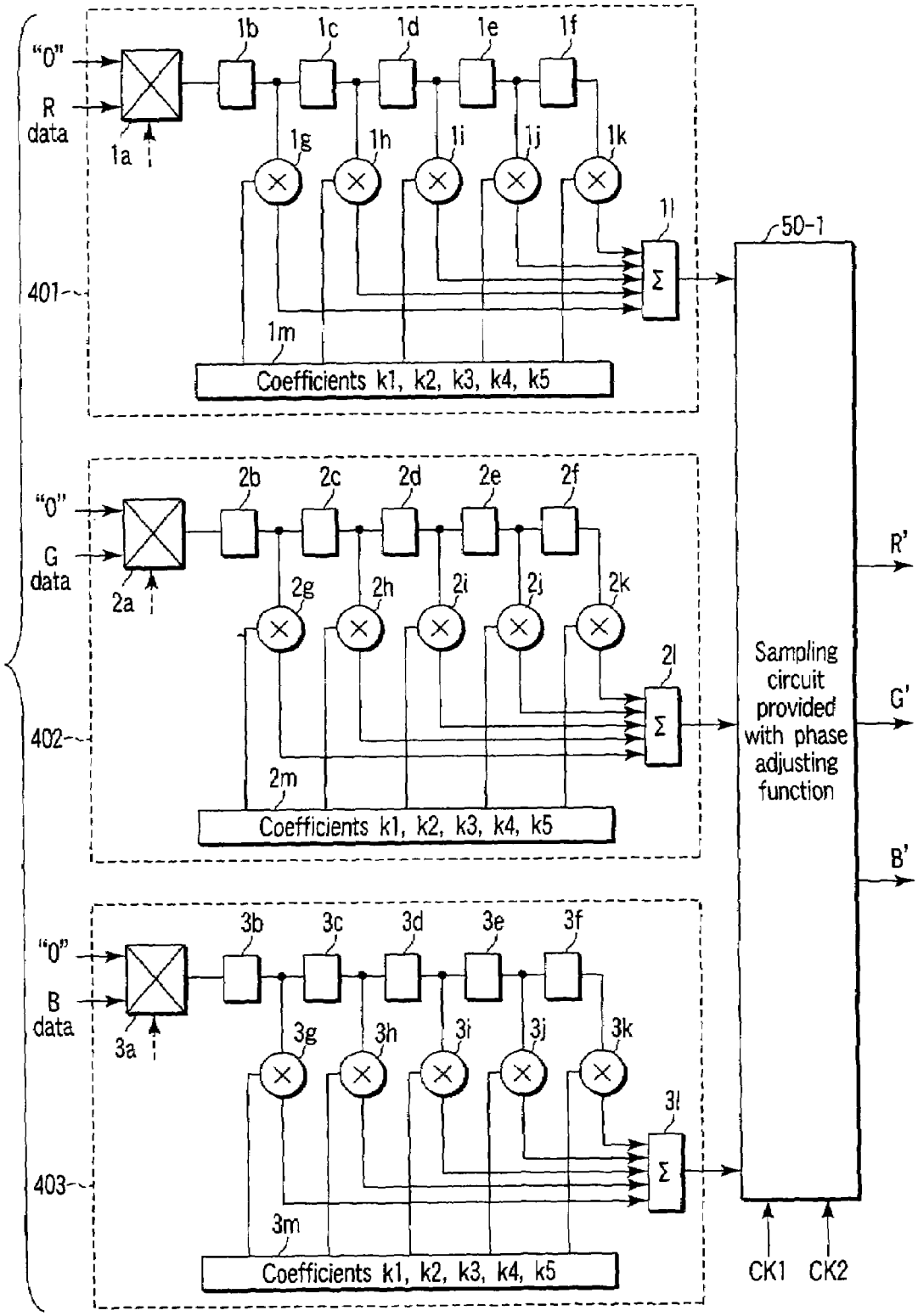
FIG. 20 is an explanatory view showing a constitution example of the interpolation circuit in still another embodiment of the unit of the present invention.

FIG. 20 shows still another embodiment of the present invention. This embodiment is a modification of the embodiment shown in FIG. 4. In the embodiment of FIG. 4, the RGB signals are phase-adjusted in such a manner as to have appropriate phases in the R signal processing circuit 401, the G signal processing circuit 402, and the B signal processing circuit 403, respectively. However, in the example of FIG. 20, a sampling circuit 50-1 provided with a phase adjusting function is disposed outside an R signal processing circuit 401, a G signal processing circuit 402, and a B signal processing circuit 403. Moreover, parallel RGB signals are extracted.

Figure 21:
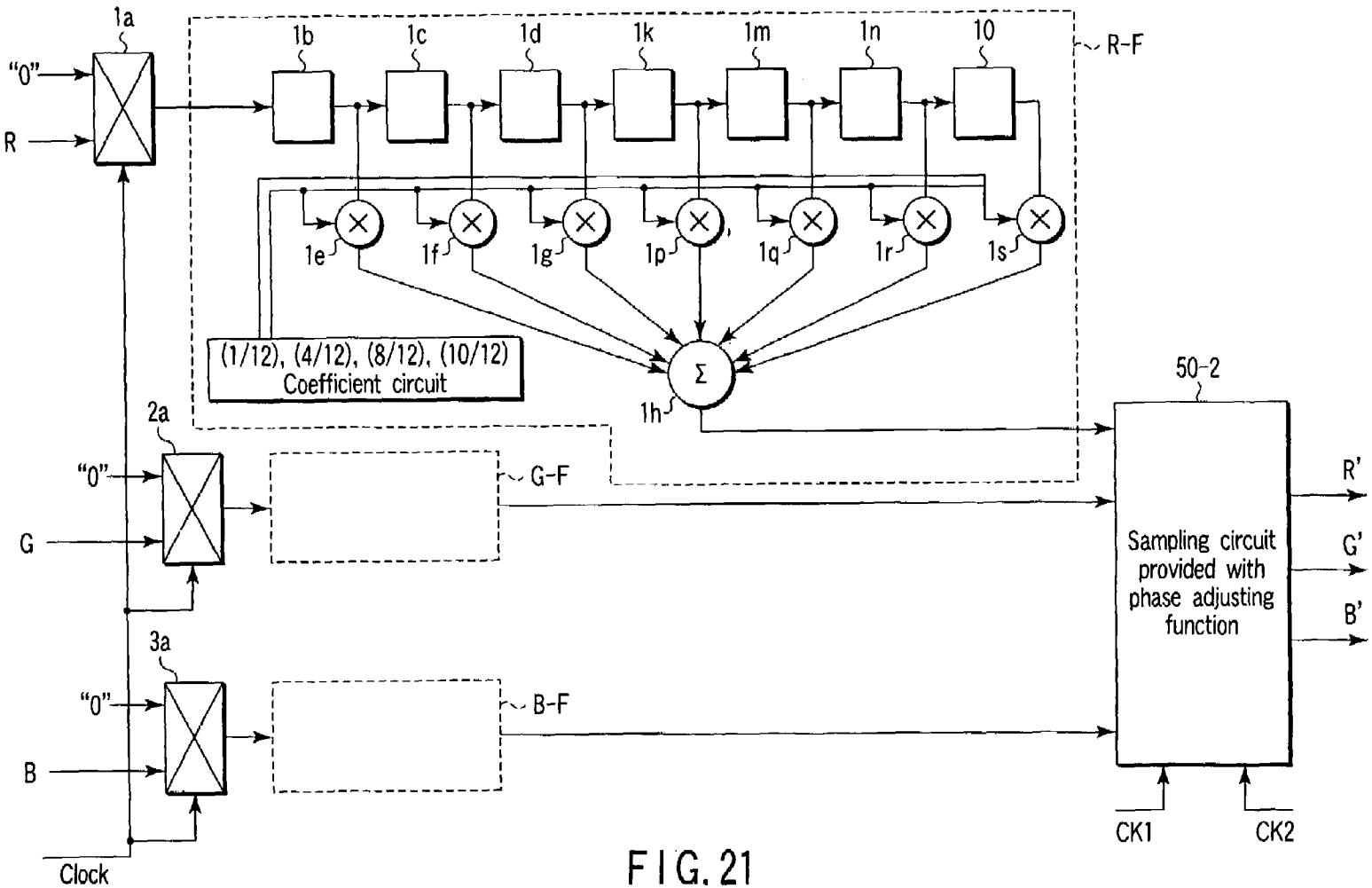
FIG. 21 is an explanatory view showing a constitution example of the interpolation circuit in still another embodiment of the unit of the present invention.
Figure 22:
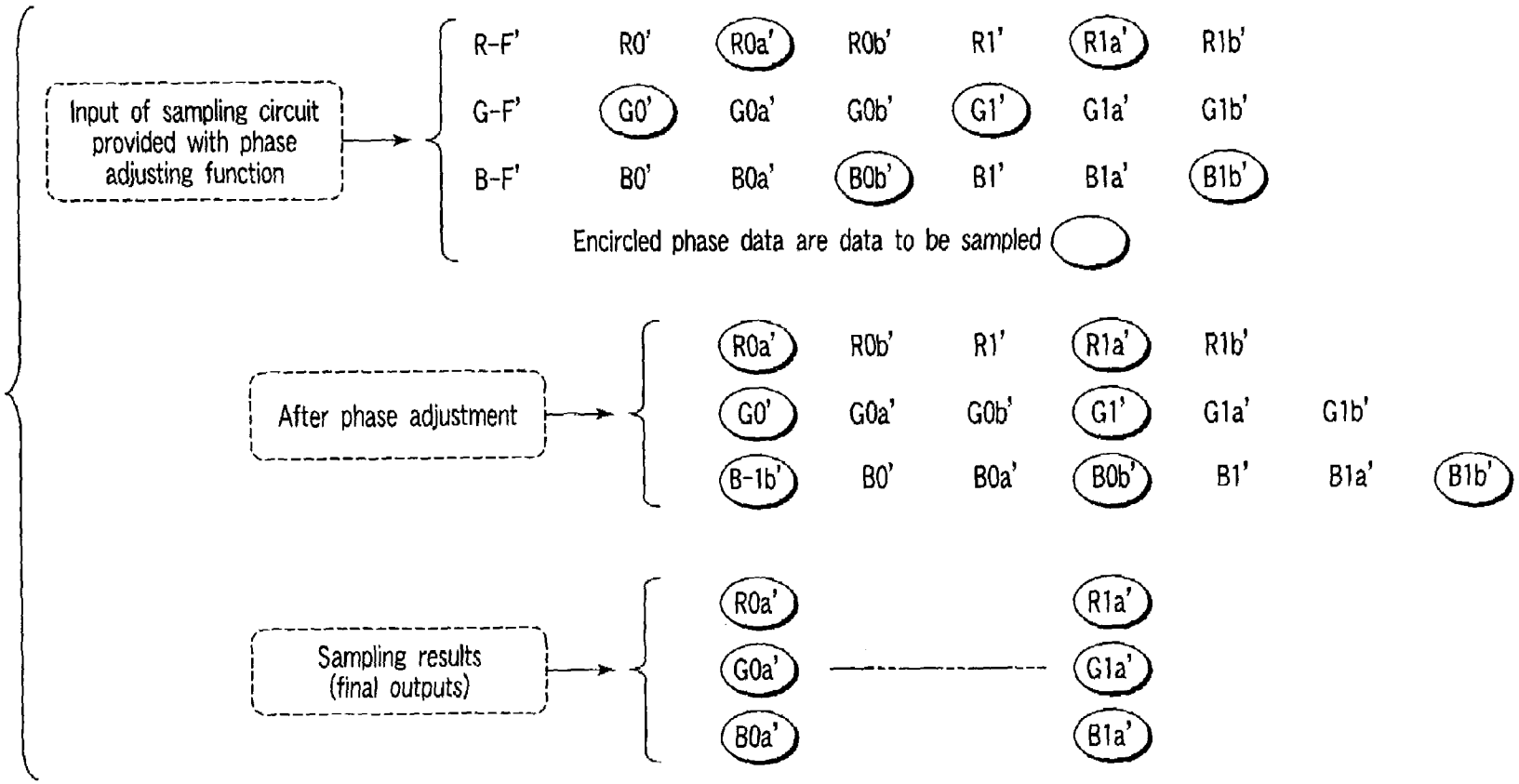
FIG. 22 is an explanatory view showing an operation of the circuit of FIG. 21.

FIG. 21 shows still another embodiment of the present invention. This embodiment is a modification of the embodiment shown in FIG. 12. In the embodiment of FIG. 12, the filtering sections R-F, G-F, B-F are provided with the sampling circuits which adjust the phases of the output signals, respectively. However, in the embodiment of FIG. 21, sampling circuits in filtering sections R-F, G-F, B-F are omitted. Moreover, there is disposed a sampling circuit 50-2 provided with a phase adjusting function, and parallel RGB signals are extracted. FIG. 22 shows behaviors of signals in the sampling circuit 50-2 provided with the phase adjusting function. Color signals input into the sampling circuit 50-2 provided with the phase adjusting function are subjected to phase adjustment. The respective phase-adjusted color signals are arranged in such a manner that required three color signals have the same phase. Three signals having the same phase are sampled and extracted.

Since the color signals corresponding to the pixel arrangement are imparted to the respective pixels by the above-described means, a picture quality level can be improved. A satisfactory resolution of the whole image is maintained. When the image moving in the horizontal direction is displayed in the screen, picture quality degradation such as bleeding of color can be inhibited. It is possible to flexibly cope with even the case where the digital signals adapted to the pixel arrangement are input.

It is to be noted that the present invention is not limited to the above-described embodiments as such, and constituting elements can be modified and embodied in a range that does not depart from the scope in an implementing stage. Various inventions can be formed by appropriate combinations of a plurality of constituting elements described in the above-described embodiments. For example, several constituting elements may be deleted from all of the constituting elements described in the embodiments. Furthermore, constituting elements ranging in different embodiments may be appropriately combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A flat display unit comprising:

a pixel group which is two-dimensionally arranged in a display region and in which pixels for red (R), green (G), and blue (B) are repeatedly arranged in a row direction;

a source drive circuit which outputs signals to a signal line group every scanning period and which supplies the signals to the corresponding pixels for red (R), green (G), and blue (B);

a color signal interpolation circuit which defines an input video signal of green (G) as a first color signal of a reference, and the other two input video signals as second and third color signals, and which multiplies a plurality of time-shifted samples of the second color signal by co-efficients, respectively, and synthesizes the samples to generate a first interpolation color signal as the R system, and which multiples a plurality of time-shifted sample of the third color signal by coefficients, respectively, and synthesizes the samples to generate a second interpolation color signal as the B system;

the color signal interpolation circuit including a circuit for defining a Gn signal as a center of a phase, denoting an integer with n, and obtaining the following calculation outputs in a position of a phase delayed behind Gn by one clock in order to obtain two interpolation samples between the respective samples of the R, G, B input video signals:

$$Rna=(2/3)\times Rn+(1/3)R(n+1),$$

$$Gna=(2/3)\times Gn+(1/3)G(n+1), \text{ and}$$

$$Bna=(2/3)\times Bn+(1/3)B(n+1);$$

a circuit for obtaining the following calculation outputs in a position of a phase advanced ahead of Gn by one clock:

$$Rnb=(1/3)Rn+(2/3)R(n+1),$$

$$Gnb=(1/3)Gn+(2/3)G(n+1), \text{ and}$$

$$Bnb=(1/3)Bn+(2/3)B(n+1); \text{ and}$$

a circuit for obtaining Gn=Gn in a phase position of Gn; and a signal output circuit which supplies to the source drive circuit the first color signal, the first interpolation color signal, and the second interpolation color signal obtained.

2. The flat display unit according to claim 1, which further subjects the signal of the phase of Gn to filtering of (¼)Gnb+(½)Gn+(¼)Gb to obtain a calculation output of ((10×Gn+G(n−1)+G(n+1))/12).

3. A flat display unit, comprising:

a pixel group which is two-dimensionally arranged in a display region and in which pixels for red (R), green (G), and blue (B) are repeatedly arranged in a row direction;

a source drive circuit which outputs signals to a signal line group every scanning period and which supplies the signals to the corresponding pixels for red (R), green (G), and blue (B);

a color signal interpolation circuit which defines an input video signal of green (G) as a first color signal of a reference, and the other two input video signals as second and third color signals;

and which multiplies a plurality of time-shifted samples of the second color signal by coefficients, respectively, and synthesizes the samples to generate a first interpolation color signal as the R system, and arranges the first interpolation color signal at the front side of the first color signal position on time axis, and which multiplies a plurality of time-shifted sample of a third color signal by coefficients, respectively, and synthesizes the samples to generate a second interpolation color signal as the B system, and a signal output circuit which supplies to the source drive circuit the first color signal, the first interpolation color signal, and the second interpolation color signal obtained, wherein the color signal interpolation circuit processes the green (G) video signal as the first color signal, the color signal interpolation circuit comprises:

a 0 insertion circuit which inserts two zeros between the respective samples with respect to the first to third color signals, respectively;

a filtering circuit which filters the respective 0-inserted color signals with different weightings, respectively; and a sampling circuit which samples and extracts the respective filtered outputs in desired phases, respectively, wherein the filtering circuit comprises at least six delay elements which successively delay the 0-inserted color signals to obtain seven output signals having different phases, defines a Gn signal as a center of a phase, denotes an integer with n, and obtains a B(n−1)b signal of a phase which is one clock before the Gn signal by a calculation of:

$$B(n-1)b=(4\times B(n-1)+8\times B(n+1))/12,$$

obtains an Rna signal of a phase which is one clock after the Gn signal by a calculation of:

$$Rna=(8\times Rn+8\times R(n+1))/12, \text{ and}$$

obtains the Gn signal by a calculation of:

$$Gn=(10\times Gn+G(n-1)+G(n+1))/12.$$

* * * * *